US005306613A

United States Patent [19]

Yagihara et al.

[11] Patent Number: 5,306,613

[45] Date of Patent: Apr. 26, 1994

[54] SILVER HALIDE PHOTOGRAPHIC MATERIAL CONTAINING SELENIUM COMPOUND

[75] Inventors: Morio Yagihara; Hiroyuki Mifune; Hirotomo Sasaki, all of Kanagawa; Shinji Kato, Gifu, all of Japan

[73] Assignee: Fuji Photo Film Co., Ltd., Kanagawa, Japan

[21] Appl. No.: 110,988

[22] Filed: Aug. 24, 1993

[30] Foreign Application Priority Data

Aug. 25, 1992 [JP] Japan ..... 4-226153

[51] Int. Cl.[5] ..... G03C 1/09

[52] U.S. Cl. ..... 430/600; 430/603; 430/604; 430/605; 430/608; 430/610; 430/613; 430/614

[58] Field of Search ..... 430/600, 603, 604, 605, 430/608, 610, 613, 614

[56] References Cited

U.S. PATENT DOCUMENTS 5,028,522 7/1991 Kojima et al. ..... 430/603

FOREIGN PATENT DOCUMENTS 763827 9/1971 Belgium .
5011385 1/1991 Japan .
4-271341 9/1992 Japan .

OTHER PUBLICATIONS

English Language Abstract of JPO 4 271 341.
English Language Abstract of JPO 5 011 385.

*Primary Examiner*—Janet C. Baxter

*Attorney, Agent, or Firm*—Sughrue, Mion, Zinn, Macpeak & Seas

[57] ABSTRACT

A silver halide photographic material comprises a silver halide emulsion layer and a non-light-sensitive hydrophilic colloidal layer provided on a support. The silver halide emulsion layer or the hydrophilic colloidal layer contains a selenium compound represented by the formula (I), (II) or (III):

(I)

(II)

(III)

in which $R^{11}$ is an aliphatic, aromatic or heterocyclic group, $—OR^{13}$ or $—NR^{14}R^{15}$; each of $R^{13}$, $R^{14}$ and $R^{15}$ is hydrogen or an aliphatic or aromatic group; Ch is S, Se or Te; $R^{12}$ is an aliphatic, aromatic or heterocyclic group or $—COR^{16}$; each of $R^{16}$, $R^{21}$ and $R^{31}$ has the same meaning as that of $R^{11}$; $M^1$ is Ge, Sn or Pb; $M^2$ is Ni, Pd or Pt; each of $R^{22}$ and $R^{32}$ is an aliphatic or aromatic group; and each of n and m is 1 or 2.

22 Claims, No Drawings

SILVER HALIDE PHOTOGRAPHIC MATERIAL CONTAINING SELENIUM COMPOUND

FIELD OF THE INVENTION

The present invention relates to a silver halide photographic material, more particularly to a silver halide photographic material containing a new selenium compound in a silver halide emulsion layer or a non-light-sensitive hydrophilic colloidal layer.

BACKGROUND OF THE INVENTION

A silver halide emulsion used for a silver halide photographic material is usually chemically sensitized with various chemical sensitizers to obtain a desired sensitivity or gradation. Examples of the chemical sensitizers include a sulfur sensitizer, a selenium sensitizer, a tellurium sensitizer, a noble metal (such as gold) sensitizer, a reduction sensitizer and a combination thereof.

An improvement of the silver halide photographic material has increasingly been demanded for several years. The recent photographic material requires very high sensitivity. Further, an improvement of the graininess and the sharpness has been required with respect to the formed image. A rapid image forming process such as a quick development process is also required. The sensitization and the sensitizers have been improved to meet these requirements.

Sulfur sensitization has most frequently been used in the silver halide photography. Numerous sulfur sensitizers have been known and used in silver halide photographic materials.

On the other hand, the sensitizing effect of selenium sensitization is higher than the effect of the sulfur sensitization. Accordingly, various selenium sensitizers have been proposed in place of the sulfur sensitizers. However, the proposed selenium sensitizers have a tendency that fogs easily occur in the image and gradation of the image is softened. Therefore, the selenium sensitizers should be further improved to be used in place of the conventional sulfur sensitizers. U.S. Pat. No. 3,297,447 discloses selenourea derivatives (e.g., dimethylselenourea) as improved selenium sensitizers. However, the improvement is still insufficient, and a rather dense fog is observed in the image (cf., Tables 1–5 in Examples of the present specification).

The sulfur sensitization and the selenium sensitization are usually used in combination with a gold sensitization. The combinations of the sensitizations remarkably improve the sensitivity of the photographic material. However, the combinations also increase the degree of fog in the image. The fog in the gold-selenium sensitization is more remarkable than that in the gold-sulfur sensitization. Accordingly, the fog caused by a selenium sensitizer should be reduced particularly in the case that the selenium sensitizer is used in combination with a gold sensitizer.

Further, the selenium sensitizers are usually not stable compounds. The sensitivity of a silver halide photographic material sensitized with a selenium sensitizer is sometime changed while the material is preserved. Therefore, a stable selenium sensitizer has also been required.

SUMMARY OF THE INVENTION

An object of the present invention is to provide a silver halide photographic material of high sensitivity which is almost free from fog and is excellent in stability and color sensitivity.

The present invention provides a silver halide photographic material which comprises a silver halide emulsion layer and a non-light-sensitive hydrophilic colloidal layer provided on a support, wherein the silver halide emulsion layer or the hydrophilic colloidal layer contains a selenium compound represented by the formula (I), (II) or (III):

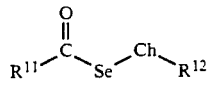

(I)

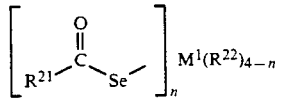

(II)

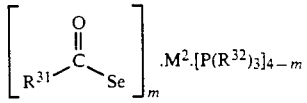

(III)

in which $R^{11}$ is an aliphatic group, an aromatic group, a heterocyclic group, $-OR^{13}$ or $-NR^{14}R^{15}$; each of $R^{13}$, $R^{14}$ and $R^{15}$ independently is hydrogen, an aliphatic group or an aromatic group; Ch is S, Se or Te; $R^{12}$ is an aliphatic group, an aromatic group, a heterocyclic group or $-COR^{16}$; $R^{16}$ is an aliphatic group, an aromatic group, a heterocyclic group, $-OR^{17}$ or $-NR^{18}R^{19}$; each of $R^{17}$, $R^{18}$ and $R^{19}$ independently is hydrogen, an aliphatic group or an aromatic group; $R^{21}$ is an aliphatic group, an aromatic group, a heterocyclic group, $-OR^{23}$ or $-NR^{24}R^{25}$; each of $R^{23}$, $R^{24}$ and $R^{25}$ independently is hydrogen, an aliphatic group or an aromatic group; $M^1$ is Ge, Sn or Pb; $R^{22}$ is an aliphatic group or an aromatic group; n is 1 or 2; $R^{31}$ is an aliphatic group, an aromatic group, a heterocyclic group, $-OR^{33}$ or $-NR^{34}R^{35}$; each of $R^{33}$, $R^{34}$ and $R^{35}$ independently is hydrogen, an aliphatic group or an aromatic group; $M^2$ is Ni, Pd or Pt; $R^{32}$ is an aliphatic group or an aromatic group; m is 1 or 2; and each of the aliphatic, aromatic and heterocyclic groups may have one or more substituent groups.

The silver halide photographic material of the present invention contains a new selenium compound represented by the formula (I), (II) or (III). The new selenium compound has a sufficient sensitizing effect, but does not increase the fog in the image. Therefore, the silver halide photographic material of the invention shows a high sensitivity, while the obtained image is almost free from fog.

Further, the new selenium compound is excellent in stability. Therefore, the sensitivity of the photographic material of the invention is also stable, even if the material is preserved under severe conditions or for a long term.

DETAILED DESCRIPTION OF THE INVENTION

The formulas (I) to (III) are described below in more detail.

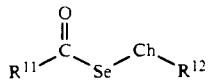

(I)

In the formula (I), $R^{11}$ is an aliphatic group, an aromatic group, a heterocyclic group, $—OR^{13}$ or $—NR^{14}R^{15}$. An aromatic group, $—OR^{13}$ and $—NR^{14}R^{15}$ are preferred.

Each of $R^{13}$, $R^{14}$ and $R^{15}$ independently is hydrogen, an aliphatic group or an aromatic group. An aliphatic group and an aromatic group are preferred.

Ch is S, Se or Te.

$R^{12}$ is an aliphatic group, an aromatic group, a heterocyclic group or $—COR^{16}$. An aromatic group and $—COR^{16}$ are preferred. $R^{11}$ and $R^{16}$ preferably are identical to form a symmetrical chemical structure, where $R^{12}$ is $—COR^{16}$. In this case, Ch preferably is Se.

$R^{16}$ is an aliphatic group, an aromatic group, a heterocyclic group, $—OR^{17}$ or $—NR^{18}R^{19}$. A heterocyclic group, $—OR^{17}$ and $—NR^{18}R^{19}$ are preferred.

Each of $R^{17}$, $R^{18}$ and $R^{19}$ independently is hydrogen, an aliphatic group or an aromatic group. An aliphatic group and an aromatic group are preferred.

The above-mentioned aliphatic groups include an alkyl group, an alkenyl group, an alkynyl group and an aralkyl group. The aliphatic group may have any of straight, branched and cyclic structures.

The alkyl group preferably has 1 to 30 carbon atoms, and more preferably has 1 to 20 carbon atoms. Examples of the alkyl groups include methyl, ethyl, n-propyl, isopropyl, t-butyl, n-octyl, n-decyl, n-hexadecyl, cyclopentyl and cyclohexyl.

The alkenyl group preferably has 2 to 30 carbon atoms, and more preferably has 2 to 20 carbon atoms. Examples of the alkenyl groups include allyl, 2-butenyl and 3-pentenyl.

The alkynyl group preferably has 2 to 30 carbon atoms, and more preferably has 2 to 20 carbon atoms. Examples of the alkynyl groups include propargyl and 3-pentynyl.

The aralkyl group preferably has 7 to 30 carbon atoms, and more preferably has 7 to 20 carbon atoms. Examples of the aralkyl groups include benzyl and phenethyl.

The above-mentioned aromatic group is an aryl group.

The aryl group preferably has 6 to 30 carbon atoms, and more preferably has 6 to 20 carbon atoms. Examples of the aryl groups include phenyl and naphthyl.

The above-mentioned heterocyclic group preferably has a three-membered to ten-membered heterocyclic ring, and more preferably has a five-membered or six-membered ring. The heterocyclic group preferably has an aromaticity. At least one hetero atom contained in the ring preferably is nitrogen, oxygen or sulfur. The heterocyclic group may be either saturated or unsaturated. The heterocyclic ring may be condensed with another heterocyclic ring or an aromatic ring. Examples of the heterocyclic groups include pyridyl, furyl, thienyl, thiazolyl, imidazolyl and benzimidazolyl.

The above-mentioned aliphatic, aromatic and heterocyclic groups may have one or more substituent groups.

Examples of the substituent groups include an aliphatic group (e.g., an alkyl group, an aralkyl group, an alkenyl group, an alkynyl group), an aromatic group (i.e., an aryl group), a heterocyclic group, an alkoxy group, an aryloxy group, amino, a substituted amino group (e.g., an amido group, an ureido group, a sulfonamido group, a phosphoric amido group, a diacylamino group, an imido group), carbamoyl, sulfamoyl, a sulfonyl group, a sulfinyl group, an alkoxycarbonyl group, an aryloxycarbonyl group, an acyl group, an acyloxy group, an alkylthio group, an arylthio group, a halogen atom, cyano, sulfo, carboxyl, hydroxyl, phosphono, nitro and a phosphineselenoyl group. Two or more substituent groups may be different from each other. The substituent groups may be further substituted with another group.

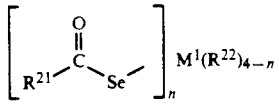

(II)

In the formula (II), $R^{21}$ is an aliphatic group, an aromatic group, a heterocyclic group, $—OR^{23}$ or $—NR^{24}R^{25}$. An aromatic group, $—OR^{23}$ and $—NR^{24}R^{25}$ are preferred.

Each of $R^{23}$, $R^{24}$ and $R^{25}$ independently is hydrogen, an aliphatic group or an aromatic group. An aliphatic group and an aromatic group are preferred.

$M^1$ is Ge, Sn or Pb.

$R^{22}$ is an aliphatic group or an aromatic group. An alkyl group and an aryl group are preferred.

In the formula (II), n is 1 or 2.

The two or three groups represented by $R^{22}$ may be different from each other (though they are preferably identical). When n is 2, the two groups represented by $R^{21}$ may also be different from each other (though they are preferably identical).

The definitions and the substituent groups of the above-mentioned aliphatic, aromatic and heterocyclic groups are the same as those described in the formula (I).

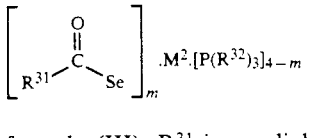

(III)

In the formula (III), $R^{31}$ is an aliphatic group, an aromatic group, a heterocyclic group, $—OR^{33}$ or $—NR^{34}R^{35}$. An aromatic group, $—OR^{33}$ and $—NR^{34}R^{35}$ are preferred.

Each of $R^{33}$, $R^{34}$ and $R^{35}$ independently is hydrogen, an aliphatic group or an aromatic group. An aliphatic group and an aromatic group are preferred.

$M^2$ is Ni, Pd or Pt.

$R^{32}$ is an aliphatic group or an aromatic group.

In the formula (III), m is 1 or 2.

The three groups represented by $R^{32}$ may be different from each other (though they are preferably identical). The two or three groups represented by $P(R^{32})_3$ may also be different from each other (though they are preferably identical). When m is 2, the two groups represented by $R^{31}$ may also be different from each other (though they are preferably identical).

The definitions and the substituent groups of the above-mentioned aliphatic, aromatic and heterocyclic groups are the same as those described in the formula (I).

Examples of the compounds represented by the formula (I) are shown below.

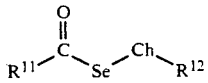
(I)
| No. | $R^{11}$ | Ch | $R^{12}$ |
|---|---|---|---|
| I-1 | $CH_3$ | Se | Phenyl |
| I-2 | tert-$C_4H_9$ | Se | Phenyl |
| I-3 | $C_8H_{17}$ | S | Phenyl |
| I-4 | $C_{16}H_{33}$ | Te | Phenyl |
| I-5 | Phenyl | Se | Phenyl |
| I-6 | 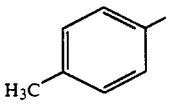 | Se | Phenyl |
| I-7 | 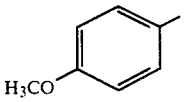 | S | Phenyl |
| I-8 | 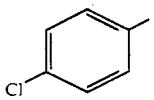 | S | $CH_3$ |
| I-9 | 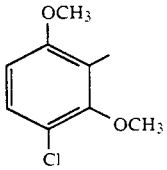 | S | $C_2H_5$ |
| I-10 | 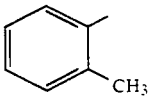 | Se | 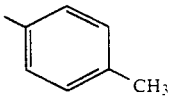 |
| I-11 | 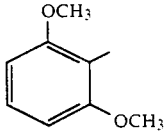 | Se | 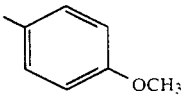 |
| I-12 | 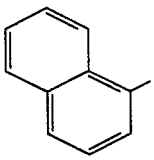 | Se | 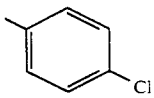 |
| I-13 | 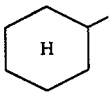 | S | 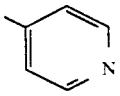 |
| I-14 | 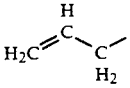 | S | 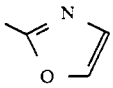 |
| I-15 | 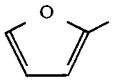 | S | Phenyl |
| I-16 | 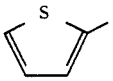 | Se | Phenyl |
-continued
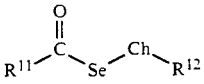
(I)
| No. | $R^{11}$ | Ch | $R^{12}$ |
|---|---|---|---|
| I-17 | 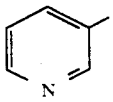 | Se | Phenyl |
| I-18 | $C_2H_5O$ | S | Phenyl |
| I-19 | 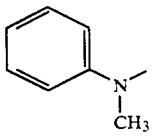 | Se | 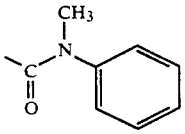 |
| I-20 | 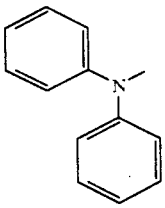 | Se | Phenyl |
| I-21 | Phenyl | Se | 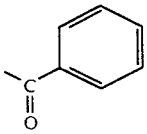 |
| I-22 | 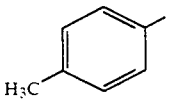 | Se | 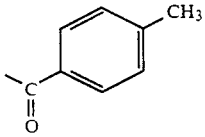 |
| I-23 | 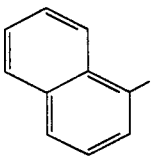 | Se | 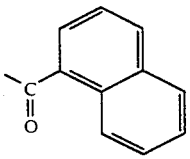 |
| I-24 | $CH_3$ | Se | 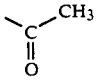 |
| I-25 | tert-$C_4H_9$ | Se | 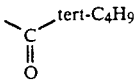 |
| I-26 | $C_{12}H_{25}$ | Se | 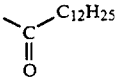 |
| I-27 | 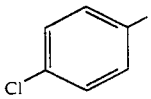 | Se | 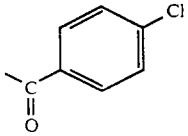 |

-continued

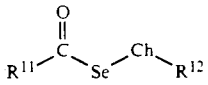

(I)

| No. | $R^{11}$ | Ch | $R^{12}$ |
|---|---|---|---|
| I-28 | 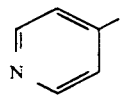 | Se | 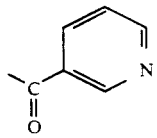 |
| I-29 | 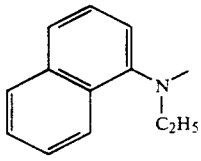 | Se | 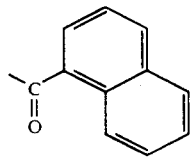 |
| I-30 | Phenyl | Te | Phenyl |
| I-31 | H 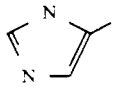 | S | Phenyl |

Examples of the compounds represented by the formula (II) are shown below.

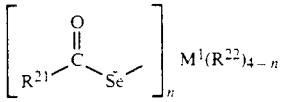

(II)

| No. | $R^{21}$ | n | $M^1$ | $R^{22}$ |
|---|---|---|---|---|
| II-1 | Phenyl | 1 | Sn | Phenyl |
| II-2 | Phenyl | 1 | Sn | $CH_3$ |
| II-3 | 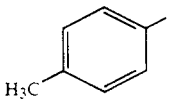 | 1 | Sn | $C_4H_9$ |
| II-4 | $CH_3$ | 1 | Sn | Phenyl |
| II-5 | tert-$C_4H_9$ | 1 | Sn | Phenyl |
| II-6 | 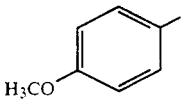 | 1 | Sn | 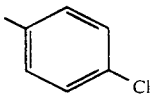 |
| II-7 | 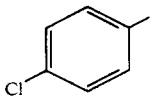 | 1 | Sn | $C_8H_{17}$ |
| II-8 | Phenyl | 2 | Sn | Phenyl |
| II-9 | Phenyl | 1 | Pb | Phenyl |
| II-10 | 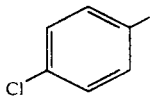 | 1 | Pb | Phenyl |

-continued

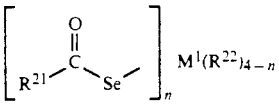

(II)

| No. | $R^{21}$ | n | $M^1$ | $R^{22}$ |
|---|---|---|---|---|
| II-11 | 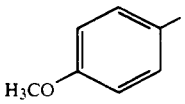 | 1 | Pb | Phenyl |
| II-12 | 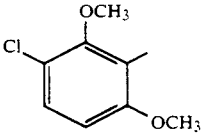 | 1 | Pb | Phenyl |
| II-13 | $CH_3$ | 1 | Pb | Phenyl |
| II-14 | tert-$C_4H_9$ | 1 | Pb | Phenyl |
| II-15 | $CH_3$ | 2 | Pb | Phenyl |
| II-16 | 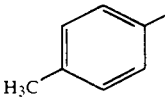 | 2 | Pb | Phenyl |
| II-17 | Phenyl | 1 | Ge | Phenyl |
| II-18 | 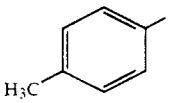 | 1 | Ge | Phenyl |
| II-19 | $CH_3$ | 1 | Ge | 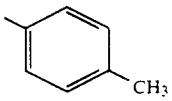 |
| II-20 | Phenyl | 2 | Ge | Phenyl |
| II-21 | $CH_3$ | 2 | Ge | Phenyl |
| II-22 | 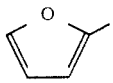 | 1 | Sn | Phenyl |
| II-23 | 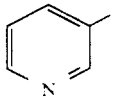 | 1 | Sn | Phenyl |
| II-24 | 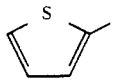 | 1 | Sn | Phenyl |

Examples of the compounds represented by the formula (III) are shown below.

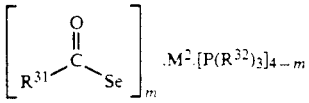

(III)

| No. | $R^{31}$ | m | $M^2$ | $R^{32}$ |
|---|---|---|---|---|
| III-1 | $CH_3$ | 2 | Pd | $C_2H_5$ |
| III-2 | $CH_3$ | 2 | Pd | Phenyl |
| III-3 | tert-$C_4H_9$ | 2 | Pd | Phenyl |
| III-4 | Phenyl | 2 | Pd | Phenyl |

-continued (III)

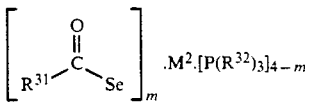

| No. | $R^{31}$ | m | $M^2$ | $R^{32}$ |
|---|---|---|---|---|
| III-5 | 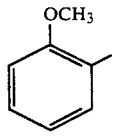 | 2 | Pd | Phenyl |
| III-6 | 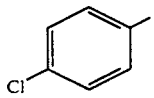 | 2 | Pd | Phenyl |
| III-7 | 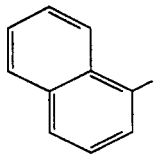 | 2 | Pd | Phenyl |
| III-8 | 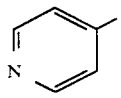 | 2 | Pd | $CH_3$ |
| III-9 | $CH_3$ | 2 | Pt | Phenyl |
| III-10 | tert-$C_4H_9$ | 2 | Pt | Phenyl |
| III-11 | Phenyl | 2 | Pt | Phenyl |
| III-12 | 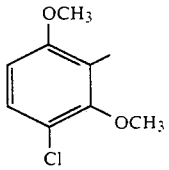 | 2 | Pt | $C_2H_5$ |
| III-13 | 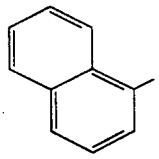 | 2 | Pt | $CH_3$ |
| III-14 | 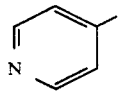 | 2 | Pt | Phenyl |
| III-15 | 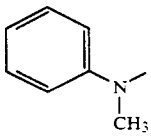 | 2 | Pt | Phenyl |
| III-16 | $C_2H_5O$ | 2 | Pt | Phenyl |
| III-17 | $CH_3$ | 2 | Ni | $C_2H_5$ |
| III-18 | tert-$C_4H_9$ | 2 | Ni | Phenyl |
| III-19 | Phenyl | 2 | Ni | Phenyl |
| III-20 | $C_6H_{13}O$ | 2 | Ni | Phenyl |

-continued (III)

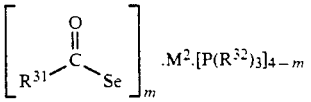

| No. | $R^{31}$ | m | $M^2$ | $R^{32}$ |
|---|---|---|---|---|
| III-21 | 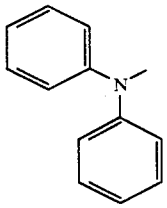 | 2 | Ni | Phenyl |
| III-22 | 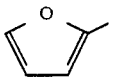 | 2 | NI | Phenyl |
| III-23 | 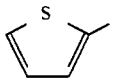 | 2 | Ni | Phenyl |
| III-24 | 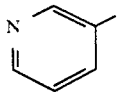 | 2 | Ni | Phenyl |

A synthesis example of the selenium compound is shown below. The other selenium compounds can also be synthesized in a similar manner.

SYNTHESIS EXAMPLE

Synthesis of Selenium Compound (II-8, Triphenyl tin benzenecarboselenolato)

In atmosphere of argon, 3.68 g of metallic sodium, 6.31 g of selenium powder and 2.0 g of naphthalene were mixed with 300 ml of dry tetrahydrofuran (THF). The mixture was stirred at 66° C. for 4 hours. The reaction mixture was cooled to 0° C., and 20 ml of dry THF solution of 11.2 g of benzoyl chloride was added to the mixture. The mixture was stirred at room temperature for 3 hours. The resulting mixture was cooled to 0° C., and 30.8 g of triphenyl tin chloride was added to the mixture. The mixture was stirred at room temperature for 1 hour. A precipitate was filtered out, and the filtrate was condensed to obtain crystals. The crystals were purified by silica gel column chromatography (hexane/dichloromethane = 1/1), and was recrystallized (hexane/ethyl acetate = 5/1). Thus, 20 g of white crystals was obtained. The melting point was 106 to 108° C., and the yield was 45 %. The subject compound (II-8) was confirmed by a nuclear magnetic resonance spectrum, a mass spectrum and an elemental analysis.

As is shown in the Synthesis example 1, the selenium compound represented by the formula (II) can be synthesized by a reaction of triorgano tin chloride with sodium selenocarboxylate, which is synthesized from a carboxylic acid chloride and sodium selenide. The compound represented by the formula (I) can be synthesized by a reaction of the compound of the formula (II) with an aryl bromide.

The above-mentioned reactions in the synthesis of the compounds of the formulas (I) and (II) are described in "Jour. Organometal. Chem.," 386, 333, 1990; "Synthesis," 12, 929, 1983; "Synthesis," 2, 128, 1983; and Z. Naturforsch. Sect. B, vol. 47, p. 558, 1992.

The selenium compound represented by the formula (III) can be synthesized by forming a transition metal complex of Ni, Pd or Pt with the compound of the formula (I). The synthesis of the transition metal complex is described in "Summaries of the 19th Symposium or Heteroatom Chem." p. 45.

Two or more selenium compounds represented by the formula (I), (II) or (III) can be used in combination.

The amount of the selenium compound for chemical sensitization of a silver halide emulsion depends on the nature of the selenium compound, the nature of the silver halide grains and the conditions in the chemical sensitization. The amount of the selenium sensitizer is usually in the range of $10^{-8}$ to $10^{-4}$ mol, and preferably in the range of $10^{-7}$ to $5\times10^{-5}$ mol, based on 1 mol of silver halide.

The chemical sensitization using the selenium sensitizer is conducted preferably at a pAg value of 6 to 11, and more preferably at a pAg value of 7 to 10, and most preferably at a pAg value of 7 to 9.5. The selenium sensitization is preferably conducted at a pH in the range of 3 to 10, and more preferably in the range of 4 to 8. The temperature of the selenium sensitization is preferably in the range of 40° to 95 ° C., and more preferably in the range of 50° to 85° C.

The selenium compounds represented by the formula (I), (II) and (III) can be used in combination with the other known selenium sensitizers. The known selenium sensitizers are disclosed in U.S. Pat. No. 1,574,944, No. 1,602,592, No. 1,623,499, No. 3,297,446, No. 3,297,447, No. 3,320,069, No. 3,408,196, No. 3,408,197, No. 3,442,653, No. 3,420,670 and No. 3,591,385, French Patents No. 2,093,038 and No. 2,093,209, Japanese Patent Publications No. 52(1977)-34491, No. 52(1977)-34492, No. 53(1978)-295 and No. 57(1982)-22090, Japanese Patent Provisional Publications No. 59(1984) 180536, No. 59(1984)-185330, No. 59(1984)-181337, No. 59(1984)-187338, No. 59(1984)-192241, No. 60(1985)-150046, No. 60(1985)-151637 and No 61(1986)-246738, British Patents No. 255,846 and No. 861,984, Japanese Patent Provisional Publications No. 4(1992)-25832, No. 4(1992)-109240 and No. 4(1992)-147250, and H.E. Spencer et al., "Journal of Photographic Science," Vol. 31, pp. 158.169, 1983.

A sulfur sensitization, a tellurium sensitization, a noble metal (e.g., gold) sensitization or a reduction sensitization can be used in combination with the selenium sensitization. In the present invention, a gold sensitization is preferably used in combination with the selenium sensitization.

In the sulfur sensitization, a labile sulfur compound is used. The labile sulfur compounds are described in P. Grafkides "Chimie et Physique Photographique," Paul Momtel, 5th ed., 1987 and "Research Disclosure," Vol. 307, No. 307105.

Examples of the sulfur sensitizers include thiosulfates, thioureas, thioamides, rhodanines, phosphine sulfides, 4-oxo-oxazolidine-2-thiones, disulfides, polysulfides, mercapto compounds, polythionate salts, elemental sulfur and active gelatin. An example of the thiosulfate is hypo. Examples of the thioureas include diphenylthiourea, triethylthiourea, N-ethyl-N'-(4-methyl-2-thiazolyl)thiourea and carboxymethyltrimethylthiourea. An example of the thioamide is thioacetamide. Examples of the rhodanines include diethyl rhodanine and 5-benzylidene-N-ethyl-rhodanine. An example of the phosphine sulfide is trimethylphosphine sulfide. Examples of the disulfides include dimorpholine disulfide and cystine. An example of the polysulfide is hexathiocane-thione. An example of the mercapto compound is cysteine. The sulfur sensitizers can be used in an amount of about $10^{-7}$ to $10^{-2}$ mol based on 1 mol of silver halide.

In the tellurium sensitization, a labile tellurium compound is used. The labile tellurium compounds are described in Canadian Patent No. 800,958, British Patents No. 1,295,462 and No. 1,396,696, and Japanese Patent Applications No. 2(1990)-333819, No. 3(1991) 53693, No. 3(1991)-131598 and No. 4(1992)-129787.

Examples of the tellurium sensitizers include telluroureas, phosphine tellurides, diacyltellurides, diacylditellurides, isotellurocyanates, telluroamides, tellurohydrazides, telluroesters, telluroketones, colloidal tellurium, tellurides, ditellurides and other tellurium compounds. Examples of the telluroureas include tetramethyltellurourea, N,N'-dimethylethylenetellurourea and N,N'-diphenylethylenetellurourea. Examples of the phosphine tellurides include butyldiisopropylphosphine telluride, tributylphosphine telluride, tributoxyphosphine telluride and ethoxydiphenylphosphine telluride. Examples of the diacyltellurides include bis(N-phenyl-N-methylcarbamoyl)telluride and bis(ethoxycarbonyl)telluride. Examples of the diacylditellurides include bis(diphenylcarbamoyl)ditelluride and bis(N-phenyl-N-methylcarbamoyl)ditelluride. An example of the telluroester is butylhexyltelluroester. An example of the telluroketone is telluroacetophenone. Examples of the other tellurium compounds include potassium telluride and sodium telluropentathionate.

In the noble metal sensitization, a salt of a noble metal (e.g., gold, platinum, palladium, iridium) is used. The noble metal salts are described in P. Grafkides "Chimie et Physique Photographique," Paul Momtel, 5th ed., 1987. A gold compound is preferably used as the noble metal sensitizer. Examples of the gold sensitizers include chloroauric acid, potassium chloroaurate, potassium aurithiocyanate, gold sulfide and gold selenide. Further, gold compounds described in U.S. Pat. No. 2,642,361, No. 5,049,484 and No. 5,049,948 are also available. The noble metal sensitizer can be used in an amount of $10^{-7}$ to $10^{-2}$ mol based on 1 mol of silver halide.

In the reduction sensitization, a reducing compound is used. The reducing compounds are described in P. Grafkides "Chimie et Physique Photographique," Paul Momtel, 5th ed., 1987 and "Research Disclosure," Vol. 307, No. 307105. Examples of the reducing compounds include aminoiminomethanesulfinic acid (i.e., thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfites, aldehyde compounds and hydrogen gas. The reduction sensitization can also be conducted in an atmosphere of high pH or excess silver ion (which is referred to as silver ripening).

In the present invention, the selenium sensitization is preferably conducted in the presence of a silver halide solvent. Examples of the silver halide solvents include thiocyanate salts (e.g., potassium thiocyanate), thioethers (e.g., 3,6-dithia-1,8-octanediol), tetra-substituted thiourea compounds (e.g., tetramethylthiourea), thion compounds, mercapto compounds, mesoionic compounds, selenoethers, telluroethers and sulfites. Ammonia, potassium rhodanide, ammonium rhodanide and amine compounds are also available as the silver halide solvent. The thiocyanate salt, the thioether, the tetra-substituted thiourea compound and the thion compound are preferred. The thiocyanate salt is particularly preferred. The thioethers are described in U.S. Pat. No. 3,021,215, No. 3,271,157, No. 3,574,628, No. 3,704,130, No. 4,276,374 and No. 4,297,439, Japanese Patent Publication No. 58(1983)-30571, and Japanese Patent Provisional Publication No. 60(1985)-136736. The tetra-substituted thiourea compounds are described in U.S. Pat. No. 4,221,863 and Japanese Patent Publication No. 59(1984)-11892. The thion compounds are described in Japanese Patent Publication No. 60(1985) 29727, and Japanese Patent Provisional Publications No. 53(1978)-144319, No. 53(1978)-82408 and No. 55(1980)-77737. The mercapto compounds are described in Japanese Patent Publication No. 63(1988)-29727. The mesoionic compounds are described in Japanese Patent Provisional Publication No. 60(1985)-163042. The selenoethers are described in U.S. Pat. No. 4,782,013. The telluroethers are described in Japanese Patent Provisional Publication No. 2(1990)-118566. The amine compounds are described in Japanese Patent Provisional Publication No. 54(1979)-100717. The silver halide solvent is preferably used in an amount of $10^{-5}$ to $10^{-2}$ mol based on 1 mol of silver halide.

The silver halide emulsion preferably is a silver bromide, silver iodobromide, silver iodochlorobromide, silver chlorobromide or silver chloride emulsion.

The shape of the silver halide grain may be either in the form of a regular crystal such as cube and octahedron or in the form of an irregular crystal such as globular shape and tabular shape. The shape of the grain may be complex of these crystals A mixture of these crystals is also available. The regular crystal is particularly preferred.

The silver halide grain may have either a homogeneous structure or a heterogeneous structure in which halogen compositions inside and outside are different from each other. A latent image may be mainly formed either on surface of the grain (e.g., a negative emulsion) or inside the grain (e.g., an internal latent image emulsion or a prefogged direct reversal emulsion). The latent image is preferably formed on surface of the grain.

The silver halide emulsion preferably is a tabular grain emulsion in which tabular silver halide grains are contained in an amount of 50% or more based on the total projected area of all the grains The tabular silver halide grains have a thickness of not more than 0.5μm (preferably not more than 0.3μm), a diameter of not less than 0.6μm and a mean aspect ratio of not less than 5. Further, the silver halide emulsion preferably is a monodispersed emulsion, which has such an almost uniform grain size distribution that a statistic coefficient of variation is not more than 20%. The coefficient of variation (S/d) is determined by dividing a standard deviation (S) by a diameter (d), which is determined by approximating the projected area of the grain to a circle. A mixture of the tabular grain emulsion and the monodispersed emulsion is also available.

The silver halide emulsion can be prepared by conventional processes, which are described in P. Glafkides, Chimie er Physique Photographique (Paul Momtel Co., 1967); G.F. Duffin, Photographic Emulsion Chemistry (Focal Press, 1966); and V.L. Zelikman et al, Making and Coating Photographic Emulsion (Focal Press, 1964).

The previously mentioned silver halide solvent can be used to control the grain growth in formation of the silver halide grains.

At the stage for formation of the silver halide grains or physical ripening thereof, a cadmium salt, a zinc salt, a thallium salt, an iridium salt (or its complex salt), a rhodium salt (or its complex salt) or an iron salt (or its complex salt) can be added to the emulsion.

A hydrophilic colloid is used as a binder or a protective colloid for the emulsion layer or an intermediate layer of the photographic material of the invention. Gelatin is an advantageous hydrophilic colloid. The other protective colloids are also available. Examples of the other protective colloids include proteins such as a gelatin derivative, a graft polymer of gelatin and another polymer, albumin and casein; saccharide derivatives such as a cellulose derivative (e.g., hydroxyethyl cellulose, carboxymethyl cellulose and cellulose sulfate), sodium alginate and a starch derivative; and synthetic hydrophilic homopolymers or copolymers such as polyvinyl acetal, a partial acetal of polyvinyl alcohol, poly-N-vinylpyrrolidone, polyacrylic acid, polymethacrylic acid, polyacrylamide, polyvinyl imidazole and polyvinyl pyrazole.

Examples of gelatin used for the layers include general-purpose lime-processed gelatin, acid-processed gelatin and enzyme-processed gelatin. The enzyme-processed gelatin is described in Bull. Soc. Phot. Japan, No. 16, pp. 30 (1980). A hydrolysis product of gelatin is also available.

The hydrophilic colloidal layer (e.g., silver halide emulsion layer, a backing layer) of the photographic material can contain an inorganic or organic hardening agent. Examples of the hardening agents include a chromium salt, an aldehyde, an N-methylol compound, an active halogen compound, an active vinyl compound, an N-carbamoylpyridinium salt and a haloamidinium salt. Examples of the aldehydes include formaldehyde, glyoxal and glutaraldehyde. An example of the N-methylol compound is dimethylol urea. Examples of the active halogen compounds include 2,4-dichloro-6-hydroxy 1,3,5-triazine and sodium salt thereof. Examples of the active vinyl compounds include 1,3-bisvinylsulfonyl-2-propanol, 1,2-bis(vinylsulfonylacetamide)ethane, bis(vinylsulfonylmethyl)ether and a vinyl polymer having vinylsulfonyl group on its side chain. An example of the N-carbamoylpyridinium salt is 1-morpholinocarbonyl-3-pyridinio)methanesulfonate. An example of the haloamidinium salt is 1-(1-chloro-1-pyrizino-methylene)pyrrolizinium 2-naphthalenesulfonate.

The active halogen compound, the active vinyl compound, the N-carbamoylpyridinium salt and the haloamidinium salt are preferred because they quickly harden the layers. The active halogen compound and the active vinyl compound are particularly preferred because they give a stable photographic property to the photographic material.

The silver halide emulsion can be spectrally sensitized with a sensitizing dye. Examples of the sensitizing dyes include a methine dye, a cyanine dye, a merocyanine dye, a complex cyanine dye, a complex merocyanine dye, a holopolar cyanine dye, a hemicyanine dye, a styryl dye and a hemioxonol dye. The cyanine dye, the merocyanine dye and the complex merocyanine dye are particularly preferred. These dyes have a basic heterocyclic ring, which is generally contained in the cyanine dyes. Examples of the ring include a pyrroline ring, an oxazoline ring, a thiazoline ring, a pyrrole ring, an oxazole ring, a thiazole ring, a selenazole ring, an imidazole ring, a tetrazole ring and a pyridine ring. Further, an alicyclic hydrocarbon ring or an aromatic hydrocarbon ring may be condensed with the above-described ring. Examples of the condensed ring include an indolenine ring, a benzindolenine ring, an indole ring, a benzoxazole ring, a naphthooxazole ring, a benzthiazole ring, a naphthothiazole ring, a benzserenazole ring, a benzimidazole ring and a quinoline ring. These rings may have a substituent group which is attached to the carbon atom of the rings.

The merocyanine dye or the complex merocyanine dye can contain a five-membered or six-membered heterocyclic ring having a ketomethylene structure. Examples of the heterocyclic rings include pyrazoline-5-one rings, thiohydantoin rings, 2-thiooxazolidine-2,4-dione rings, thiazolidine-2,4-dione rings, rhodanine rings and thiobarbituric acid rings.

Two or more sensitizing dyes can be used in combination. A combination of the sensitizing dyes is often used for supersensitization. In addition to the sensitizing dyes, a supersensitizer can be contained in the silver halide emulsion. The supersensitizer itself does not exhibit a spectral sensitization effect or does not substantially absorb visible light, but shows a supersensitizing activity. Examples of the supersensitizer include an aminostilbene compound substituted with a nitrogen-containing heterocyclic group, a condensate of an aromatic organic acid with formaldehyde, a cadmium salt, an azaindene compound and a combination thereof. A combination of the supersensitizers is particularly preferred. The aminostilbene compound is described in U.S. Pat. No. 2,933,390 and No. 3,635,721. The condensate of an aromatic organic acid and formaldehyde is described in U.S. Pat. No. 3,743,510. The combinations of the supersensitizers are described in U.S. Pat. No. 3,615,613, No. 3,615,641, No. 3,617,295 and No. 3,635,721.

The silver halide emulsion may contain an antifogging agent or a stabilizer. The antifogging agent prevents occurrence of a fog. The stabilizer has a function of stabilizing the photographic property. The antifogging agent and the stabilizer are used in preparation, storage or processing stage of the photographic material. Examples of the antifogging agents and stabilizers include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5-mercaptotetrazole); mercaptopyrimidines; mercaptotriazines; thioketone compounds such as oxazolinethione; azaindenes such as triazaindenes, tetraazaindenes (e.g., 4-hydroxy-substituted (1,3,3a,7)tetraazaindenes) and pentaazaindenes; and amides such as benzenethiosulfonic amide, benzenesulfinic amide and benzenesulfonic amide.

The photographic material of the present invention may contain a surface active agent to improve various properties such as a coating property, an antistatic property, a slip property, an emulsifying or dispersing property, an antitacking property and photographic properties (e.g., development acceleration, high contrast and sensitization).

The hydrophilic colloidal layer of the photographic material may contain a water-soluble dye. The water-soluble dye has various functions such as a function of antiirradiation or a function of antihalation as well as a function as a filter dye. Examples of the dyes include an oxonol dye, a hemioxonol dye, a styryl dye, a merocyanine dye, an anthraquinone dye, an azo dye, a cyanine dye, an azomethine dye, a triarylmethane dye and a phthalocyanine dye. Further, an oil-soluble dye can be also added to the hydrophilic colloidal layer by emulsifying the dye in water by a known oil droplet dispersing method.

The photographic material of the invention can be used as a multi-layered multicolor photographic material. The multi-layered material comprises a support and two or more silver halide emulsion layers which have different spectral sensitivities.

The multi-layered color photographic material generally comprises at least one red-sensitive emulsion layer, at least one green-sensitive emulsion layer and at least one blue-sensitive emulsion layer on the support. The arrangement of those layers can optionally be determined. Preferably, the red-sensitive layer, the green-sensitive layer and the blue-sensitive layer are arranged from the support in the order. The blue-sensitive layer, the greensensitive layer and the red-sensitive layer can be arranged in the order from the support. The blue-sensitive layer, the red-sensitive layer and the green-sensitive layer can also be arranged in the order from the support. Further, two or more emulsion layers which are sensitive to the same color but show different sensitivities can be provided to enhance the sensitivity. Three emulsion layers can be provided to improve the graininess of the image. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer, to enhance the sensitivity.

The red-sensitive emulsion layer generally contains a cyan coupler, the green-sensitive emulsion layer generally contains a magenta coupler, and the blue-sensitive emulsion layer generally contains a yellow coupler. However, other combinations are also available. For example, an infrared sensitive layer can be used to prepare a false color film or a film for exposure to a semiconductor laser beam.

Various color couplers can be used for the photographic material of the invention. The color couplers are described in the patents cited in Research Disclosure No. 17643, VII C-G.

Yellow couplers are described in U.S. Pat. No. 3,933,501, No. 4,022,620, No. 4,326,024 and No. 4,401,752, Japanese Patent Publication No. 58(1983)-10739, and British Patents No. 1,425,020 and No. 1,476,760.

Preferred magenta couplers are 5-pyrazolone type and pyrazoloazole type compounds. The magenta couplers are described in U.S. Pat. No. 4,310,619 and No. 4,351,897, European Patent No. 73,636, U.S. Pat. No. 3,061,432 and No. 3,725,067, Research Disclosure No. 24220 (June, 1984), Japanese Patent Provisional Publication No. 60(1985)-33552, Research Disclosure No.

24230 (June, 1984), Japanese Patent Provisional Publication No. 60(1985).43659, and U.S. Pat. No. 4,500,630 and No. 4,540,654.

Preferred cyan couplers are phenol type and naphthol type couplers. The cyan couplers are described in U.S. Pat. No. 4,052,212, No. 4,146,396, No. 4,228,233, No. 4,296,200, No. 2,369,929, No. 2,801,171, No. 2,772,162, No. 2,895,826, No. 3,772,002, No. 3,758,308, No. 4,334,011 and No. 4,327,173, West German Patent Publication No. 3,329,729, European Patents No. 121,365A and No. 161,626A, and U.S. Pat. No. 3,446,622, No. 4,333,999, No. 4,451,559 and No. 4,427,767.

A colored coupler may be used to compensate incidental absorption of a formed dye. The colored coupler are described in Research Disclosure No. 17643, VII-G, U.S. Pat. No. 4,163,670, Japanese Patent Publication No. 57(1982)-39413, U.S. Pat. No. 4,004,929 and No. 4,138,258, and British Patent No. 1,146,368.

The photographic material can contain a coupler which gives a developed color dye having an appropriate diffusion property. Such couplers are described in U.S. Pat. No. 4,366,237. British Patent No. 2,125,570, European Patent No. 96,570, and West German Patent Publication No. 3,234,533.

A polymerized dye-forming coupler is also available. The dye-forming couplers are described in U.S. Pat. No. 3,451,820, No. 4,080,211 and No. 4,367,282, and British Patent No. 2,102,173.

The photographic material can contain a coupler which releases a photographic functional residue according to a coupling reaction. For example, a DIR coupler releases a development inhibitor. The DIR couplers are described in Research Disclosure No. 17643, VII-F, Japanese Patent Provisional Publications No. 57(1982) 151944, No. 57(1982)-54234 and No. 60(1985) 184248, and U.S. Pat. No. 4,248,962.

The photographic material can also contain a coupler which imagewise releases a nucleating agent or a development accelerator in a development process. Such couplers are described in British Patents No. 2,097,140 and No. 2,131,188, and Japanese Patent Provisional Publications No. 59(1984)-157638 and No. 59(1984)-170840.

Examples of other couplers include a competing coupler, a polyvalent coupler, a DIR redox compound, a DIR coupler-releasing coupler, a coupler which releases a dye having restoration to original color after an elimination reaction, a bleach accelerator-releasing coupler and a coupler which releases ligand. The competing coupler is described in U.S. Pat. No. 4,130,427. The polyvalent coupler is described in U.S. Pat. No. 4,283,472, No. 4,338,393 and No. 4,310,618. The DIR redox compound-releasing couplers, the DIR coupler-releasing couplers, the DIR coupler-releasing redox compounds and the DIR redox-releasing redox compounds are described in Japanese Patent Provisional Publications No. 60(1985)-185950 and No. 62(1987)-24252. The coupler which releases a dye having restoration to original color after elimination is described in European Patent No. 173,302A. The bleach accelerator-releasing coupler is described in Research Disclosure No. 11449, ibid. No. 24241, and Japanese Patent Provisional Publication No. 61(1986)-201247. The coupler which releases ligand is described in U.S. Pat. No. 4,553,477.

The couplers can be introduced into the photographic material by various known dispersing methods. A high-boiling solvent can be used in an oil in water dispersing method. The high-boiling solvents are described in U.S. Pat. No. 2,322,027.

The high-boiling organic solvents usually have a boiling point of not lower than 175° C. under a normal pressure. Examples of the high-boiling organic solvents include phthalic esters, phosphoric esters, phosphonic esters, benzoic esters, amides, alcohols, phenols, aliphatic carboxylic esters, aniline derivatives and hydrocarbons. Examples of the phthalic esters include dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate and bis(1,1-diethylpropyl)phthalate. Examples of the phosphoric esters include triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphate. Examples of the benzoic esters include 2-ethylhexyl benzoate, dodecyl benzoate and 2-ethylhexyl-p-hydroxybenzoate. Examples of the amides include N,N-diethyldodecanamide, N,N-diethyllaurylamide and N-tetradecylpyrrolidone. An example of the alcohol is isostearyl alcohol. An example of the phenol is 2,4-ditert-amylphenol. Examples of the aliphatic carboxylic esters include bis(2-ethylhexyl)sebacate, dioctyl azelate, glycerol tributyrate, isostearyl lactate and trioctyl citrate. An example of the aniline derivative is N,N-dibutyl-2-butoxyl-5-tert-octylaniline. Examples of the hydrocarbons include paraffin, dodecylbenzene and diisopropylnaphthalene.

In addition to the high-boiling organic solvent, an organic solvent can be used as an auxiliary solvent. The auxiliary solvent has a boiling point of not lower than about 30° C., and preferably in the range of 50° C. to 160° C. Examples of the auxiliary solvents include ethyl acetate, butyl acetate, ethyl propionate, methyl ethyl ketone, cyclohexanone, 2-ethoxyethyl acetate and dimethylformamide.

A latex dispersing method is available in preparation of the photographic material. A process of the latex dispersing method, effects thereof and examples of latex for impregnation are described in U.S. Pat. No. 4,199,363, and West German Patent Applications (OLS) No. 2,541,274 and No. 2,541,230.

There is no specific limitation on the support on which the above-mentioned silver halide emulsion layer is provided. Various flexible and rigid materials can be used as the support. The flexible materials include plastic films, papers and cloths. The rigid materials include glass, ceramics and metals. Preferred examples of the flexible materials include semi-synthetic or synthetic polymers such as cellulose nitrate, cellulose acetate, cellulose butyl acetate, polystyrene, polyvinyl chloride, polyethylene terephthalate and polycarbonate; baryta papers; and other papers coated or laminated with α-olefin polymers (e.g., polyethylene, polypropylene or ethylenebutene copolymer). The support can be colored with dyes or pigments. Further, the support can also be made black for light-blocking. The surface of the support is generally subjected to undercoating treatment to enhance the adhesion with the silver halide emulsion layer. The surface of the support may be further subjected to other various treatments such as glow discharge, corona discharge, irradiation with ultraviolet rays and flame treatment before or after the undercoating treatment.

The silver halide emulsion layer and other hydrophilic colloidal layers can be coated on the support by a known coating method such as dip coating, roller coating, flood coating and extrusion coating. If desired, two or more layers can be simultaneously coated by the coating methods, as is described in U.S. Pat. No. 2,681,294, No. 2,761,791, No. 3,526,528 and No. 3,508,947.

The photographic material of the invention can be used as a monochromatic or color photographic material. In more detail, the photographic material can be used as a color negative film for domestic use or cinematographic use; and other film or paper for slide projection use or television use, such as a color reversal film, a color paper, a color positive film, a color reversal paper, a color diffusion transfer type photographic material and a heat development type color photographic material. Further, the photographic material can also be used as a monochromatic light-sensitive material for X-rays by using a mixture of three-color couplers, as is described in "Research Disclosure," No. 17,123, (July, 1978), or by using black color-forming coupler described in U.S. Pat. No. 4,126,461 and British Patent No. 2,102,136. Moreover, the photographic material of the invention can be also used as a film for plate making (e.g., lithographic films and scanner films), an X-ray film for medical use or industrial use, a monochromatic negative film for picture-taking, a monochromatic photographic paper, a microfilm for COM use or domestic use, and other light-sensitive printing material (e.g., silver salt diffusion transfer type photographic material, print out type photographic material).

The photographic material of the present invention can be used in a color diffusion transfer process. The color diffusion transfer process can be classified into a peel apart type, an integrated type and a film unit type which does not require peeling. The integrated type is described Japanese Patent Publications No. 46(1971)-16356 and No. 48(1973)-33697, Japanese Patent Provisional Publication No. 50(1975)-13040, and British Patent No. 1,330,524. The film unit type is described in Japanese Patent Provisional Publication No. 57(1982)-19345.

An acidic polymer layer protected with a neutralization timing layer can be advantageously used in the color diffusion transfer photographic material, because the layer have a function of allowing a broad latitude of the processing temperature. The acidic polymer may be added to a developing solution.

Various exposure means can be employed for exposure of the photographic material of the invention. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, and flash light sources (e.g., electric flash and metal-burning flashbulb). Light sources which emit light in the ultraviolet to infrared region can be also used as the recording light sources. For example, there can be mentioned gasses, dye solutions, semiconductor lasers, light emission diode, and plasma light source. Also employable are fluorescent surface given by the stimulated phosphor with electron rays (e.g., CRT) and an exposure means in which a microshutter array using liquid crystal (LCD) or lanthanum-doped lead zirconate titanate (PLZT) is combined with a linear or plane-like light source. The spectral distribution used in the exposure process can be appropriately adjusted by color filters.

A color developing solution used in the development process of the photographic material according to the invention preferably is an alkaline aqueous solution containing an aromatic primary amine color developing agent as a host component. Aminophenol compounds and p-phenylenediamine compounds are preferably used as the color developing agent. Examples of the p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline and 3-methyl-4-amino-N-ethyl-N-β-methoxyethylaniline. Sulfates, hydrochlorides and p-toluenesulfonates of those compounds are also available. Salts of diamines are generally preferred to free diamines because the salts are more stable than the free diamines.

The color developing solution generally contains pH buffering agents (e.g., carbonates of alkali metals, borates thereof and phosphates thereof), development inhibitors (e.g., bromides, iodides, benzimidazoles, benzothiazoles and mercapto compounds) and antifogging agents. If necessary, the color developing solution may further contain other additives such as preservatives (e.g., hydroxylamine and sulfite), organic solvents (e.g., triethanol amine and diethylene glycol), development accelerators (e.g., benzyl alcohol, polyethylene glycol, quarternary ammonium salts and amines), nucleus-forming agents (e.g., color-forming couplers, completing couplers and sodiumboron hydrides), development-assisting agents (e.g., 1-phenyl-3-pyrazolidone), viscosity-increasing agents, chelating agents (e.g., aminopolycarboxylic acid, aminopolyphosphonic acid, alkylphosphonic acid and phosphonocarboxylic acid), and antioxidants described in West German Patent Application (OLS) No. 2,622,950.

In the development process of color reversal photographic materials, color development is generally made after monochromatic development. A monochromic developing solution used in the mcnochromatic development generally contains various monochromatic developing agents such as dihydroxybenzenes (e.g., hydroquinone), 3-pyrazolidones (e.g., 1-phenyl-3-pyrazolidone), and aminophenols (e.g., N-methyl-p-aminophenol). Those monochromatic developing agents can be employed singly or in combination.

The silver halide emulsion layer is generally subjected to bleaching process after the color development process. The bleaching process can be conducted simultaneously with or separately from a fixing process. For the rapid processing, a bleach-fix process can be conducted after the bleaching process. Bleaching solutions usually contain polyvalent metals such as iron(III), cobalt(III), chromium(IV) and copper(II), peracids, quinones and nitroso compounds. Examples of the bleaching agents include ferricyanides; dichromates; organic complex salts of iron(III) or cobalt(III), persulfates, manganates and nitrosophenol. Examples of the organic complex salts of iron(III) or cobalt(III) include complex salts thereof with aminopolycarboxylic acids and complex salts thereof with organic acids. Examples of the aminopolycarboxylic acids include ethylenediaminetetraacetic acid, diethylenetriaminepentaacetic acid, nitrilotriacetic acid and 1,3-diamino-2-propanoltetraacetic acid. Examples of the organic acids include citric acid, tartaric acid and malic acid. Ethylenediaminetetraacetic acid iron(III) satt, diethylenetriaminepentaacetic acid iron(III) salt and persulfate are preferred from the viewpoints of rapid processing and prevention of environmental pollution. Particularly, the ethylenediaminetetraacetic acid iron(III) complex salt is preferably used in a bleaching solution (in bleaching bath) or a bleach-fix solution.

A bleaching accelerator can be optionally used in the bleaching bath, the bleach-fix bath or the prior bath to those baths. Examples of the bleaching accelerators include compounds having mercapto group or disulfide group as described in U.S. Pat. No. 3,893,858, West German Patents No. 1,290,812 and No. 2,059,988, Japanese Patent Provisional Publications No. 53(1978)-32736, No. 53(1978)-57831, No. 53(1978)-37418, No. 53(1978)-65732, No. 53(1978)-72623, No. 53(1978)-95630, No. 53(1978)-95631, No. 53(1978)-104232, No. 53(1978)-124424, No. 53(1978)-141623 and No. 53(1978)-28426, and Research Disclosure No. 17129 (July, 1978); thiazolidine derivatives as described in Japanese Patent Provisional Publication No. 50(1975)-140129; thiourea derivatives as described in Japanese Patent Publication No. 45(1970)-8506, Japanese Patent Provisional Publications No. 52(1977)-20832 and No. 53(1978)-32735, and U.S. Pat. No. 3,706,561; iodides as described in West German Patent No. 1,127,715 and Japanese Patent Provisional Publication No. 58(1983)-16235; polyethylene oxides as described in West German Patents No. 966,410 and No. 2,748,430; polyamine compounds as described in Japanese Patent Publication No. 45(1970)-8836; and other compounds as described in Japanese patent Provisional Publications No. 49(1974)-42434, No. 49(1974)-59644, No. 53(1978)-94927, No. 54(1979)35727, No. 55(1980)-26506 and No. 58(1983)-163940. In addition to the above-mentioned compounds, iodine ion and bromine ion can also be available as the bleaching accelerator. As the bleaching accelerator, preferred are compounds having mercapto group or disulfide group because these compounds show high acceleration effects, and particularly compounds described in U.S. Pat. No. 3,893,858, West German Patent No. 1,290,812 and Japanese Patent Provisional Publication No. 53(1978)-95630 are preferred. Also preferred are compounds described in U.S. Pat. No. 4,552,834. The above-mentioned bleaching accelerators may be contained in the photographic material. Employment of the bleaching accelerators is particularly effective in the bleach-fix process of color photographic materials for picture-taking.

Examples of fixing agents include thiosulfates, thiocyanates, thioether compounds, thioureas, and iodides. When iodides are used as the fixing agents, they are used in a large amount. Of the above-mentioned compounds, thiosulfates are generally used. A preservative can be used in the bleach-fix solution or the fixing solution. Examples of the preservatives include sulfites, bisulfites and carbonylbisulfurous acid addition products.

After the bleach-fix process or the fixing process, the photographic material is generally subjected to washing and stabilization. In the washing stage or the stabilization stage, a variety of known compounds can be used for preventing precipitation and saving water. For example, there can be used hard water-softening agents for preventing the precipitation, such as inorganic phosphoric acids, aminopolycarboxylic acids, organic aminopolyphosphoric acids and organic phosphoric acids; germicides, mildewcides and metal salts (e.g., magnesium salts, aluminum salts and bismuth salts) for preventing various bacteria, alga and mildew; surface active agents for preventing drying strain or drying mark; and various hardeners for film-hardening. Moreover, compounds described in L.E. West, Photographic Science And Engineering, Vol. 6, pp 344–359, (1955) can be also employed. Chelating agents and mildewcides are particularly preferred.

In the washing process, countercurrent washing using two or more baths is generally employed to save water. Instead of the washing process, a multi-stage countercurrent stabilizing process as described in Japanese Patent Provisional Publication No. 57(1982)-8543 can be used, and in this process, 2–9 countercurrent baths are required. Various compounds may be added to the stabilizing baths to stabilize resulting images in addition to the above-mentioned additives. For example, various buffering agents for adjusting pH value of the resulting films (for example, adjusting to pH of 3–9), and aldehydes (e.g., formalin) may be added. Concrete examples of the buffering agents include borates, metaborates, borax, phosphates, carbonates, potassium hydroxide, sodium hydroxide, ammonia water, monocarboxylic acids, dicarboxylic acids and polycarboxylic acids. They may be used in combination. Further, other additives such as chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, isothiazolone, 4-thiazolinebenzimidazole, halogenated phenol, sulfanilamide and benzotriazole), surface active agents, brightening agents and hardeners can be also employed, if desired. Those additives can be used in combination of two or more same kinds or different kinds.

As the pH-adjusting agents employable after the washing and stabilization processes, there can be preferably mentioned various ammonium salts such as ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage). In this case, formalin used in the stabilizing bath can be omitted when the used magenta coupler has two equivalent weights.

The time required for the washing and stabilizing process depends on the kind of the photographic material or the processing conditions, but generally is in the range of 20 seconds to 10 minutes, preferably in the range of 20 seconds to 5 minutes.

The silver halide color photographic material can contain a color developing agent for the purposes of simple processing and rapid processing. For incorporation of the color developing agent, various precursors which release the color developing agents can be preferably employed. Examples of the precursors employable for the purposes include indolenine compounds as described in U.S. Pat. No. 3,342,597; Schiff's base type compounds as described in U.S. Pat. No. 3,342,599 and Research Disclosure, Nos. 14,850 and 15,159; aldol compounds as described in Research Disclosure, No. 13,924; metal complex salts as described in U.S. Pat. No. 3,719,492; urethane compounds as described in Japanese Patent Provisional Publication No. 53(1978)-135628;

and other salt type precursors as described in Japanese Patent Provisional Publications No. 56(1981)-6235, No. 56(1981)-16133, No. 56(1981)-59232, No. 56(1981)-67842, No. 56(1981)-83734, No. 56(1981)-83735, No. 56(1981)-83736, No. 56(1981)-89735, No. 56(1981)-81837, No. 56(1981)-54430, No. 56(1981)-106241, No. 54(1979)-107236, No. 57(1982)-97531 and No. 57(1082)-83565.

Into the silver halide color photographic material of the invention may be incorporated 1-phenyl-3-pyrazolidones to accelerate color development. Typical compounds used for the purpose are described, for example, in Japanese Patent Provisional Publications No. 56(1981)-64339, No. 57(1982)-144547, No. 57(1982)-211147, No. 58(1983)-50532, No. 58(1983)-50533, No. 58(1983)-50534, No. 58(1983)-50535, No. 58(1983)-50536 and No. 58(1083)-115438.

The various processing solutions used in the above-mentioned processes may have a temperature in the range of 10° to 50° C. The temperature generally is in the range of 33° to 38° C., but it can be made higher to accelerate the processing to shorten the processing time. Otherwise, it can be made lower to improve qualities of the resulting images or to enhance the stability of the solutions. Further, cobalt intensification described in West German Patent No. 2,226,770 or hydrogen peroxide intensification described in U.S. Pat. No. 3,674,499 can be made to save the silver of the photographic material.

The above-mentioned various baths may be equipped with a heater, a temperature sensor, a liquid level sensor, a circulating pump, a filter, a floating lid or a squeegee, if desired.

In the continuous processing, a replenisher can be used for each processing solution to prevent the solution composition from varying, whereby a uniform finish can be obtained. The replenisher can be used in an amount of not more than half the standard amount to reduce the cost.

When the photographic material of the invention is used as a color paper, the above-mentioned bleach-fix process is generally made, and when the photographic material of the invention is used as a color photographic material for picture-taking, the same process is made according to the necessity.

EXAMPLE 1

Aqueous solutions of silver nitrate and potassium bromide were added to an aqueous solution of gelatin containing potassium bromide and ammonia with stirring at 60 ° C. according to a double jet method while silver potential was kept at +20 mV to saturation calomel electrode.

After the grain formation, the resulting emulsion was desalted according to a conventional flocculation method, and was washed with water. Then, gelatin and water were added to the emulsion to adjust the pH and pAg values to 6.3 and 8.5, respectively.

The obtained silver bromide emulsion is a monodispersed tetradecahedral emulsion having a mean grain diameter of 0.85μm. The face ratio of (111)/(100) is 55/45. The distribution coefficient (coefficient of variation) of the grain diameter is 12%.

The emulsion was divided into small parts, and each part was heated to 60° C. Then, to each part was added the compound set forth in Table 1 to perform chemical ripening for 60 minutes.

To each part were further added 3-{3-[2-(2,4-di-tert-amylphenoxy)butylylamino]benzoylamino}1-(2,4,6-trichlorophenyl)pyrazolone-5-one (magenta coupler), tricresyl phosphate (oil), 4-hydroxy-6-methyl-1,3,3a,7-tetraazaindene (stabilizer), sodium dodecylbenzenesulfonate (coating aid), 1,2-bis(vinylsulfonylacetylmmino)ethane (hardening agent) and phenoxyethanol (antiseptic), to prepare a coating solution.

An undercoating layer was provided on a cellulose triacetate film to prepare a support. On the support were coated the above-prepared coating solution and a gelatin solution for a protective layer containing polymethyl methacrylate grains simultaneously according to a pressing out method.

Each of the prepared samples was exposed to light through an optical wedge for 1/100 second, and was subjected to the following developing process.

The densities of the samples thus processed were measured using a green filter. The results on the photographic properties are set forth in Table 1.

In Table 1, the sensitivity is expressed by a relative reciprocal value of the exposure required to obtain an optical density of the fogging value plus 0.2. The relative value is defined in the manner that the value of the sample No. 1 is 100. The amount of the compound means an amount by mol based on 1 mol of silver halide.

TABLE 1

| Sample No. | Compound No. | Compound Amount | Fog | Sensitivity |
|---|---|---|---|---|
| 1 | A | $4 \times 10^{-6}$ | 0.28 | 100 |
| 2 | I-6 | $4 \times 10^{-6}$ | 0.20 | 105 |
| 3 | I-7 | $4 \times 10^{-6}$ | 0.10 | 132 |
| 4 | I-11 | $4 \times 10^{-6}$ | 0.19 | 96 |
| 5 | I-23 | $6 \times 10^{-6}$ | 0.18 | 115 |
| 6 | II-6 | $6 \times 10^{-6}$ | 0.22 | 100 |
| 7 | II-18 | $4 \times 10^{-6}$ | 0.18 | 110 |
| 8 | III-3 | $4 \times 10^{-6}$ | 0.21 | 108 |
| 9 | III-11 | $2 \times 10^{-6}$ | 0.11 | 129 |
| 10 | III-14 | $2 \times 10^{-6}$ | 0.16 | 112 |
| 11 | III-22 | $2 \times 10^{-6}$ | 0.14 | 120 |
| 12 | I-31 | $4 \times 10^{-6}$ | 0.22 | 102 |

Remark:
Compound (A): N,N-dimethylselenourea (disclosed in U.S. Pat. No. 3,297,447)

The developing process was carried out at 38° C. under the following conditions.

| Process | Period (sec) |
|---|---|
| 1. Color development | 165 |
| 2. Bleaching | 390 |
| 3. Washing | 195 |
| 4. Fixing | 390 |
| 5. Washing | 195 |
| 6. Stabilizing | 195 |

The compositions of the processing solutions used for each stages are as follows.

| Color developing solution | |
|---|---|
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4 (N-Ethyl-N-β-hydroxyethylamino)-2-methylaniline sulfate | 4.5 g |
| Water | to make up to 1.0l |

-continued

| | |
|---|---|
| Bleaching solution | |
| Ammonium bromide | 160.0 g |
| Ammonia water (28%) | 25.0 ml |
| Sodium ethylenediaminetetraacetate | 130 g |
| Glacial acetic acid | 14 ml |
| Water | to make up to 1.0 l |
| Fixing solution | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water | to make up to 1.0 l |
| Stabilizing solution | |
| Formalin | 8.0 ml |
| Water | to make up to 1.0 l |

As is evident from the results set forth in Table 1, in the case of using the selenium sensitizers of the invention, the occurrence of fog was lower and the sensitivity was almost equal or higher, as compared with the case of using a conventionally known sensitizer, namely, the comparative compound (A).

EXAMPLE 2

To 1 liter of an aqueous solution containing 0.05 g of potassium bromide and 30 g of gelatin were added, with stirring at 75° C., 75 ml of an aqueous solution (1M) of silver nitrate and an aqueous solution (1M) of potassium bromide simultaneously over 4 minutes while silver potential was kept at 0 mV to saturation calomel electrode.

To the resulting mixture were then added 675 ml of an aqueous solution (1M) of silver nitrate and an aqueous solution (1M) of potassium bromide over 36 minutes while silver potential was kept at −30 mV.

After the grain formation, the resulting emulsion was desalted according to a conventional flocculation method and washed with water. Then, gelatin and water were added to the emulsion to adjust the pH and pAg values to 6.4 and 8.6, respectively.

The silver bromide emulsion obtained above is a monodispersed octahedral silver bromide emulsion having a mean grain diameter of 0.25μm and a distribution coefficient of the grain diameter of 11%.

The obtained emulsion was divided into small parts, and each part was heated to 60° C. Then, to each part were added chloroauric acid ($3.2\times10^{-5}$ mol per 1 mol of silver), sodium thiosulfate ($2\times10^{-3}$ mol per 1 mol of silver) and the compound set forth in Table 2 to perform chemical ripening for 60 minutes.

Thereafter, samples were prepared in the same manner as described in Example 1, and the obtained samples were subjected to the same color developing process as described in Example 1. The results are set forth in Table 2.

Further, after the samples were stored for 2 days in an atmosphere of a temperature of 50° C. and a relative humidity of 80%, they were subjected to the same color developing process as described above.

In Table 2, the amount of the compound means an amount by mol based on 1 mol of silver. The sensitivity is expressed by a relative value defined in the manner that the value of the sample No. 16 given immediately after the preparation is 100.

TABLE 2

| Sample No. | Compound No. (Amount × $10^{-5}$ | Before Storage Fog | Before Storage Sensitivity | After Storage Fog | After Storage Sensitivity |
|---|---|---|---|---|---|
| 18 | (A (3.2) | 0.38 | 100 | 0.87 | 58 |
| 19 | I-7 (3.2) | 0.16 | 138 | 0.30 | 118 |
| 20 | I-16 (3.2) | 1.21 | 125 | 0.36 | 102 |
| 21 | III-12 (1.6) | 0.18 | 121 | 0.32 | 97 |
| 22 | III-19 (1.6) | 0.24 | 108 | 0.37 | 92 |
| 23 | II-13 (3.2) | 0.28 | 105 | 0.44 | 87 |
| 24 | A (0.8) + B (2.4) | 0.12 | 72 | 0.23 | 56 |
| 25 | I-7 (3.2) + B (2.4) | 0.10 | 96 | 0.16 | 80 |
| 26 | A (1.6) + C (1.6) | 0.32 | 174 | 0.48 | 131 |
| 27 | I-7 (1.6) + C (1.6) | 0.27 | 190 | 0.35 | 162 |

Remark:
Compound (A): N,N-dimethylselenourea
Compound (B): sodium thiosulfate
Compound (C): bis(diphenylcarbomoyl)ditelluride As is evident form the results set forth in Table 2, in the case of using the compounds of the invention, the occurrence of fog immediately after preparation of the sample (before storage) was lower and the increase of fog during the storage at a high temperature and a high humidity was simple, as compared with the case of using a conventionally known selenium sensitizer (the comparative compound (A)).

These favorable effects were kept in the case where the compounds of the invention were used in combination with a sulfur sensitizer or a tellurium sensitizer.

EXAMPLE 3

To a solution containing potassium bromide, thioether ($HO(CH_2)_2S(CH_2)_2S(CH_2)_2OH$) and gelatin were added, with stirring at 70° C., a silver nitrate solution and a solution containing potassium iodide, potassium bromide and $K_3IrCl_6$ ($3\times10^{-6}$ mol per 1 mol of silver) by a double jet method.

After the addition, the temperature of the resulting emulsion was lowered to 35° C., and the soluble salts were removed from the emulsion according to a conventional flocculation method. Then, the emulsion was again heated to 40 ° C., and 60 g of gelatin was dissolved in the emulsion to adjust the pH value to 6.8.

The tabular silver bromide grains obtained as above had a mean diameter of 1.25μm, a thickness of 0.17μm, a ratio of the mean diameter to the thickness of 7.4, and a silver iodide content of 1.5% by mol. The pAg value at 40 ° C. was 8.4.

The obtained emulsion was divided into small parts, and each part was heated at 62° C. To each part were added anhydro-5,5'-dichloro-9-ethyl-3,3'-di(3-sulfopropyl)oxacarbocyanine hydroxide sodium salt (500 mg per 1 mol of silver halide) as a sensitizing dye and potassium iodide (200 mg per 1 mol of silver halide), and were further added the sensitizer set forth in Table 3, an aqueous solution of chloroauric acid ($9\times10^{-6}$ mol per 1 mol of silver halide), an aqueous solution of potassium thiocyanate ($3.2\times10^{-4}$ mol per 1 mol of silver halide) and an aqueous solution of sodium thiosulfate ($8\times10^{-6}$ mol per 1 mol of silver halide), to perform chemical ripening for 30 minutes.

After completion of the chemical sensitization, to each emulsion (100 g, containing 0.08 mol of silver) were successively added the following compounds (1) to (4) with stirring at 40 ° C. to prepare a coating solution for an emulsion layer.

| | | |
|---|---|---|
| (1) 4-Hydroxy-6-methyl-1,3,3a,7-tetraazaindene | 3% | 2 cc |

-continued

| | | |
|---|---|---|
| (2) $C_{17}H_{35}$-O-$(CH_2CHO)_{25}$-H | 2% | 2.2 cc |
| (3) Potassium polystyrenesulfonate (polymerization degree: ca. 3,000) | 2% | 1.6 |
| (4) 2,4-Dichloro-6-hydroxy-s-triazine sodium salt | 2% | 3 cc |

Separately, a coating solution for a surface protective layer was prepared by successively adding the following components (2) to (5) to the following gelatin solution

| | | |
|---|---|---|
| (1) with stirring at 40° C. | | |
| (1) 14% Aqueous solution of gelatin | | 56.8 g |
| (2) Fine grains of polymethyl methacrylate (mean grain size: 3.0 μm) | | 3.9 g |
| (3) Emulsion | | |
| Gelatin | 10% | 4.24 g |
| 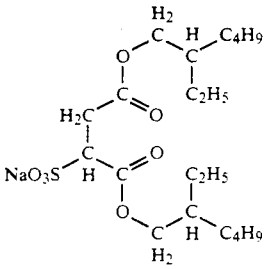 | | 0.03 g |
| Phenoxyethanol | | 0.02 g |
| 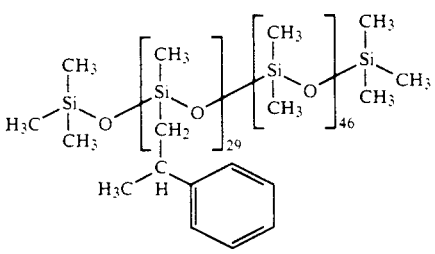 | | 0.05 g |
| (4) $H_2O$ | | 68.8 cc |
| (5) $C_8H_{17}$—$C_6H_5(OCH_2CH_2)_2CH_2CH_2SO_3Na$ | 4.3% | 3 cc |

On a polyethylene terephthalate film support were coated the coating solution for an emulsion layer and the coating solution for a surface protective layer prepared as above simultaneously according to a pressing out method so that the volume ratio between the layers was 103:45. The amount of the silver was 2.5 g/m$^2$. Each of the samples thus prepared was exposed to light for 1/100 second through an yellow filter and an optical wedge using a sensitometer. The samples were then developed with a developing solution for an automatic processing machine (RD-III produced by Fuji Photo Film Co., Ltd.) at 35° C. for 30 seconds. The samples were fixed, washed with water and dried according to a conventional method. Then, the photographic sensitivities of the samples were measured. In Table 3, the photographic sensitivity is expressed by a relative reciprocal value of the exposure required to obtain an optical density of the fogging value plus 0.2. The relative value is defined in the manner that the value of the sample No. 30 is 100. The amount of the compound means an amount by mol based on 1 mol of silver.

TABLE 3

| Sample No. | Compound No. | Compound Amount | Fog | Spectral Sensitivity |
|---|---|---|---|---|
| 30 | A | $1.5 \times 10^{-6}$ | 0.30 | 100 |
| 31 | I-7 | $1.5 \times 10^{-6}$ | 0.14 | 114 |
| 32 | I-25 | $1.5 \times 10^{-6}$ | 0.18 | 107 |
| 33 | III-13 | $8 \times 10^{-7}$ | 0.13 | 98 |
| 34 | III-20 | $8 \times 10^{-7}$ | 0.21 | 100 |

Remark: Compound (A): N,N-dimethylselenourea

As is evident from the results set forth in Table 3, in the case of using the compound of the invention for the gold-sulfur-selenium sensitization, the occurrence of fog was lower and the relative spectral sensitivity was almost equal or higher, as compared with the case of using a conventionally known selenium sensitizer (the comparative compound (A)).

EXAMPLE 4

To 1 liter of an aqueous solution containing 25 g of gelatin and 12.3 g of NaCl were added, with stirring at 50° C., an aqueous solution (1M) of $AgNO_3$ and an aqueous solution (1M) of NaCl simultaneously over 80 minutes, to obtain a cubic silver chloride emulsion having a grain size of 0.5μm.

The emulsion was desalted according to a conventional flocculation method using a high-molecular flocculating agent and washed with water. To the emulsion were then added water and gelatin to adjust the pH and pAg values to 6.2 and 7.5, respectively.

The emulsion was divided into small parts, and each part was heated to 60° C. Then, to each part was added the compound set forth in Table 4 to perform chemical ripening for 60 minutes.

Thereafter, to each part were further added gelatin, 4-hydroxy-6-methyl-1,3,3a,7-tetraazaindene and dodecylbenzenesulfonic acid soda to prepare a coating solution for an emulsion layer.

On a cellulose triacetate support were coated the above-prepared coating solution for an emulsion layer and a gelatin solution for a protective layer, to prepare samples.

Each of the samples was exposed to light for 1/100 second through an optical wedge, and was developed with the following developing solution at 20° C. for 5 minutes.

The results are set forth in Table 4. In Table 4, the spectral sensitivity is expressed by a relative reciprocal value of the exposure required to obtain an optical density of the fogging value plus 0.5. The relative value is defined in the manner that the value of the sample No. 40 is 100. The amount of the compound means an amount by mol based on 1 mol of silver.

TABLE 4

| Sample No. | Compound No. | Compound Amount | Fog | Spectral Sensitivity |
|---|---|---|---|---|
| 30 | A | $1.4 \times 10^{-6}$ | 0.30 | 100 |
| 41 | I-4 | $1.4 \times 10^{-6}$ | 0.31 | 107 |
| 42 | I-7 | $1.4 \times 10^{-6}$ | 0.26 | 120 |
| 43 | I-21 | $1.4 \times 10^{-6}$ | 0.21 | 96 |
| 44 | III-11 | $7 \times 10^{-6}$ | 0.24 | 128 |

Remark: Compound (A): N,N-dimethylselenourea

| Developing solution | |
|---|---|
| Metol | 2.5 g |
| Ascorbic acid | 10 g |

-continued

| Developing solution | |
|---|---|
| $Na_2B_4O_7.5H_3O$ | 35 g |
| Sodium chloride | 0.5 g |
| Water to make up to | 1 l |

As is evident from the results set forth in Table 4, even in the silver chloride emulsion, the compound of the invention was lower in the occurrence of fog, as compared with a conventionally known selenium sensitizer (the comparative compound (A)).

EXAMPLE 5

To 8 liters of an aqueous solution containing 72 g of gelatin and 16 g of NaCl were added an aqueous solution containing 1 kg of $AgNO_3$ and an aqueous solution containing 161 g of KBr and 265 g of NaCl simultaneously at 52° C. over 32 minutes. Over the first 10 minutes, to the mixture were further added rhodium chloride ($5\times10^{-7}$ mol per 1 mol of silver) and $K_3IrCl_6$ ($5\times10^{-7}$ mol per 1 mol of silver). Thus, a silver chlorobromide emulsion (Br: 23 mol %) having a mean grain size of about 0.3μm was prepared.

The emulsion was desalted according to a conventional flocculation method and washed with water. Then, gelatin and water were added to the emulsion to adjust the pH and pAg values 6.0 and 7.5, respectively.

The emulsion was divided into small parts, and each part was heated to 56° C. Then, to each part were added chloroauric acid ($1.6\times10^{-5}$ mol per 1 mol of silver), sodium thiosulfate ($1.6\times10^{-5}$ mol per 1 mol of silver) and the selenium sensitizer set forth in Table 5 to perform chemical sensitization for 40 minutes.

Thereafter, to each part were further added gelatin, the sensitizing dye 1, N-allylbenzothiazolium bromide, m-carboxyphenyl-5-mercaptotetrazole, 4-hydroxy-6-methyl 1,3,3a,7-tetraazaindene, phenoxyethanol, hydroquinone, polyethyl acrylate latex and 2-bis(vinylsulfonylacetamide)ethane, to prepare a coating solution for an emulsion layer.

On a polyethylene terephthalate support were coated the coating solution for an emulsion layer and a coating solution for a protective layer containing gelatin, polymethyl methacrylate, colloidal silica, polyethyl acrylate latex and sodium dodecylbenzenesulfonate simultaneously according to a pressing out method.

Each of the samples thus prepared was exposed to light for 1/100 second through an optical wedge and an yellow filter. The samples were then developed with a developing solution (LD-835 produced by Fuji Photo Film Co., Ltd.) at 38° C. for 20 seconds. The samples were fixed with a fixing solution (LF-308 produced by Fuji Photo Film Co., Ltd.) at 36° C. for 20 seconds, then washed with water and dried. Thereafter, the samples were subjected to sensitometry.

In Table 5, the photographic sensitivity is expressed by a relative reciprocal value of the exposure required to obtain an optical density of the fogging value plus 2.0. The relative value is defined in the manner that the value of the sample No. 50 is 100. The amount of the compound means an amount by mol based on 1 mol of silver.

TABLE 5

| Sample No. | Compound No. | Compound Amount | Fog | Spectral Sensitivity |
|---|---|---|---|---|
| 50 | A | $8\times10^{-6}$ | 0.08 | 100 |
| 51 | I-9 | $8\times10^{-6}$ | 0.06 | 142 |
| 52 | III-11 | $4\times10^{-6}$ | 0.06 | 129 |

Remark: Compound (A): N,N-dimethylselenourea (Sensitizing dye)

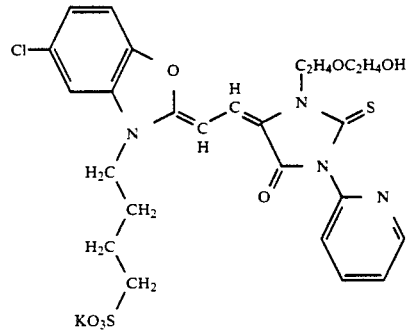

As is evident from the results set forth in Table 5, in the case of using the compounds of the present invention, the occurrence of fog was lower and the color sensitivity was higher, as compared with the case of using a conventionally known selenium sensitizer (the comparative compound (A)).

EXAMPLE 6

On a cellulose triacetate film was provided an undercoating layer to prepare a support. On the support were coated the following layers to prepare a multi-layered color photographic material (sample No. 601).

Composition of layers

The coating amounts (g/m²) are shown below. The value for silver halide means a coating amount of silver (Ag). The amount of a sensitizing dye means an amount by mol based on 1 mol of silver halide contained in the same layer.

| | |
|---|---|
| The first layer (Antihalation layer) | |
| Black colloidal silver | (Ag) 0.18 |
| Gelatin | 1.40 |
| Magenta coupler (ExM-1) | 0.18 |
| Sensitizing dye (ExF-1) | $2.0\times10^{-3}$ |
| High boiling point organic solvent (HBS-1) | 0.20 |
| The second layer (Intermediate layer) | |
| Silver halide emulsion (G) | (Ag) 0.065 |
| 2,5-Di-s-pentadecylhydroquinone | 0.18 |
| Cyan coupler (ExC-2) | 0.020 |
| Ultraviolet absorbent (UV-1) | 0.060 |
| Ultraviolet absorbent (UV-2) | 0.080 |
| Ultraviolet absorbent (UV-3) | 0.10 |
| High boiling point organic solvent (HBS-1) | 0.10 |
| High boiling point organic solvent (HBS-2) | 0.020 |
| Gelatin | 1.04 |
| The third layer (Low red sensitive layer) | |
| Silver halide emulsion (A) | (Ag) 0.25 |
| Silver halide emulsion (B) | (Ag) 0.25 |
| Sensitizing dye (ExS-1) | $6.9\times10^{-5}$ |
| Sensitizing dye (ExS-2) | $1.8\times10^{-5}$ |
| Sensitizing dye (ExS-3) | $3.1\times10^{-4}$ |
| Cyan coupler (ExC-1) | 0.17 |
| Cyan coupler (ExC-3) | 0.030 |
| Cyan coupler (ExC-4) | 0.10 |
| Cyan coupler (ExC-5) | 0.015 |
| Cyan coupler (ExC-7) | 0.0050 |
| Cyan coupler (ExC-8) | 0.02 |
| Additive (Cpd-2) | 0.01 |

-continued

| | |
|---|---|
| High boiling point organic solvent (HBS-1) | 0.040 |
| Gelatin | 0.87 |
| The fourth layer (Middle red sensitive layer) | |
| Silver halide emulsion (D) | (Ag) 0.70 |
| Sensitizing dye (ExS-1) | $3.5 \times 10^{-4}$ |
| Sensitizing dye (ExS-2) | $1.6 \times 10^{-5}$ |
| Sensitizing dye (ExS-3) | $5.1 \times 10^{-4}$ |
| Cyan coupler (ExC-1) | 0.13 |
| Cyan coupler (ExC-2) | 0.060 |
| Cyan coupler (ExC-3) | 0.007 |
| Cyan coupler (ExC-4) | 0.090 |
| Cyan coupler (ExC-5) | 0.0025 |
| Cyan coupler (ExC-7) | 0.001 |
| Cyan coupler (ExC-8) | 0.007 |
| Additive (Cpd-2) | 0.023 |
| High boiling point organic solvent (HBS-1) | 0.10 |
| Gelatin | 0.75 |
| The fifth layer (High red sensitive layer) | |
| Silver halide emulsion (E) | (Ag) 1.40 |
| Sensitizing dye (ExS-1) | $2.4 \times 10^{-4}$ |
| Sensitizing dye (ExS-2) | $1.0 \times 10^{-4}$ |
| Sensitizing dye (ExS-3) | $3.4 \times 10^{-4}$ |
| Cyan coupler (ExC-1) | 0.097 |
| Cyan coupler (ExC-2) | 0.12 |
| Cyan coupler (ExC-3) | 0.045 |
| Cyan coupler (ExC-6) | 0.020 |
| Cyan coupler (ExC-8) | 0.0025 |
| Additive (Cpd-2) | 0.050 |
| High boiling point organic solvent (HBS-1) | 0.22 |
| High boiling point organic solvent (HBS-2) | 0.10 |
| Gelatin | 1.20 |
| The sixth layer (Intermediate layer) | |
| Additive (Cpd-1) | 0.10 |
| High boiling point organic solvent (HBS-1) | 0.50 |
| Gelatin | 1.10 |
| The seventh layer (Low green sensitive layer) | |
| Silver halide emulsion (C) | (Ag) 0.35 |
| Sensitizing dye (ExS-4) | $3.0 \times 10^{-5}$ |
| Sensitizing dye (ExS-5) | $2.1 \times 10^{-4}$ |
| Sensitizing dye (ExS-6) | $8.0 \times 10^{-4}$ |
| Magenta coupler (ExM-1) | 0.010 |
| Magenta coupler (ExM-2) | 0.33 |
| Magenta coupler (ExM-3) | 0.086 |
| Yellow coupler (ExY-1) | 0.015 |
| High boiling point organic solvent (HBS-1) | 0.30 |
| High boiling point organic solvent (HBS-3) | 0.010 |
| Gelatin | 0.73 |
| The eighth layer (Middle green sensitive layer) | |
| Silver halide emulsion (D) | (Ag) 0.80 |
| Sensitizing dye (ExS-4) | $3.2 \times 10^{-5}$ |
| Sensitizing dye (ExS-5) | $2.2 \times 10^{-4}$ |
| Sensitizing dye (ExS-6) | $8.4 \times 10^{-4}$ |
| Magenta coupler (ExM-2) | 0.13 |
| Magenta coupler (ExM-3) | 0.030 |
| Yellow coupler (ExY-1) | 0.018 |
| High boiling point organic solvent (HBS-1) | 0.16 |
| High boiling point organic solvent (HBS-3) | $8.0 \times 10^{-3}$ |
| Gelatin | 0.90 |
| The ninth layer (High green sensitive layer) | |
| Silver halide emulsion (E) | (Ag) 1.25 |
| Sensitizing dye (ExS-4) | $3.7 \times 10^{-5}$ |
| Sensitizing dye (ExS-5) | $8.1 \times 10^{-4}$ |
| Sensitizing dye (ExS-6) | $3.2 \times 10^{-4}$ |
| Cyan coupler (ExC-1) | 0.010 |
| Magenta coupler (ExM-1) | 0.030 |
| Magenta coupler (ExM-4) | 0.040 |
| Magenta coupler (ExM-5) | 0.019 |
| Additive (Cpd-3) | 0.040 |
| High boiling point organic solvent (HBS-1) | 0.25 |
| High boiling point organic solvent (HBS-2) | 0.10 |
| Gelatin | 1.44 |
| The tenth layer (Yellow filter layer) | |
| Yellow colloidal silver | (Ag) 1.030 |
| Additive (Cpd-1) | 0.16 |
| High boiling point organic solvent (HBS-1) | 0.60 |
| Gelatin | 0.60 |
| The eleventh layer (Low blue sensitive layer) | |
| Silver halide emulsion (C) | (Ag) 0.18 |
| Sensitizing dye (ExS-7) | $8.6 \times 10^{-4}$ |
| Yellow coupler (ExY-1) | 0.020 |

-continued

| | |
|---|---|
| Yellow coupler (ExY-2) | 0.022 |
| Yellow coupler (ExY-3) | 0.050 |
| Yellow coupler (ExY-4) | 0.020 |
| High boiling point organic solvent (HBS-1) | 0.28 |
| Gelatin | 1.10 |
| The twelfth layer (Middle blue sensitive layer) | |
| Silver halide emulsion (D) | (Ag) 0.40 |
| Sensitizing dye (ExS-7) | $7.4 \times 10^{-4}$ |
| Cyan coupler (ExC-7) | $7.0 \times 10^{-3}$ |
| Yellow coupler (ExY-2) | 0.050 |
| Yellow coupler (ExY-3) | 0.10 |
| High boiling point organic solvent (HBS-1) | 0.050 |
| Gelatin | 0.78 |
| The thirteenth layer (High blue sensitive layer) | |
| Silver halide emulsion (F) | (Ag) 1.00 |
| Sensitizing dye (ExS-7) | $4.0 \times 10^{-4}$ |
| Yellow coupler (ExY-2) | 0.10 |
| Yellow coupler (ExY-3) | 0.10 |
| High boiling point organic solvent (HBS-1) | 0.070 |
| Gelatin | 0.86 |
| The fourteenth layer (first protective layer) | |
| Silver halide emulsion (G) | (Ag) 0.20 |
| Ultraviolet absorbent (UV-4) | 0.11 |
| Ultraviolet absorbent (UV-5) | 0.17 |
| High boiling point organic solvent (HBS-1) | $5.0 \times 10^{-2}$ |
| Gelatin | 1.00 |
| The fifteenth layer (second protective layer) | |
| Hardening agent (H-1) | 0.40 |
| Additive (B-1) (particle diameter: 1.7 μm) | $5.0 \times 10^{-2}$ |
| Additive (B-2) (particle diameter: 1.7 μm) | 0.10 |
| Additive (B-3) | 0.10 |
| Stabilizer (S-1) | 0.20 |
| Gelatin | 1.20 |

Further, the additives (W-1) to (W-3), (B-4) to (B-6), (F-1) to (F-17), an iron salt, a lead salt, a gold salt, a platinum salt, an iridium salt, a palladium salt and a rhodium salt were optionally added to each of the layers to improve storage stability, handling, pressure-resistance, antimicrobial or antibacterial property, antistatic property and coating property of the layers.

TABLE 6

| Emulsion No. | AgI cont. (%) | Mean Grain size (μm) | S/d (%) (*1) | Aspect ratio (*2) | Grain structure core ← → shell (AgI content) | | | Grain shape (*3) |
|---|---|---|---|---|---|---|---|---|
| (A) | 4.0 | 0.45 | 27 | 1 | 25% (13%) | 75% (1%) | | II-8 |
| (B) | 8.9 | 0.70 | 14 | 1 | 30% (25%) | 70% (2%) | | II-8 |
| (C) | 2.0 | 0.55 | 25 | 7 | 100% (2%) | | | I-T |
| (D) | 9.0 | 0.65 | 25 | 6 | 12% (0%) | 59% (11%) | 29% (8%) | III-T |
| (E) | 9.0 | 0.85 | 23 | 5 | 8% (0%) | 59% (11%) | 33% (8%) | III-T |
| (F) | 14.5 | 1.25 | 25 | 3 | 37% (34%) | 63% (3%) | | II-sT |
| (G) | 1.0 | 0.07 | 15 | 1 | 100% (1%) | | | I-F |

Remark
*1: distribution coefficient of grain size
*2: grain diameter/grain thickness
*3: II-8 (double layered octahedral grain)
I-T (single layered tabular grain)
III-T (triple layered tabular grain)
II-sT (double layered semitabular grain)
I-F (single layered fine grain)

(1) The emulsions (A) to (F) set forth in Table 6 were subjected to reduction sensitization during the grain formation stage using thiourea dioxide and thiosulfonic acid in accordance with the example described in Japanese Patent Provisional Publication No. 2(1990)-191938.

(2) The emulsions (A) to (F) set forth in Table 6 were subjected to gold sensitization, sulfur sensitization and selenium sensitization in the presence of spectral sensitizing dyes of each sensitive layers and sodium thiocyanate in accordance with the example described in Japanese Patent Provisional Publication No. 3(1991)-237450.

The sample No. 601-1 was prepared by using the comparative compound (A) of Example 1 in each of the emulsions (A) to (F) as a selenium sensitizer.

The sample No. 601-2 was prepared by using the compound (I-7) of the present invention in each of the emulsions (A) to (F) as a selenium sensitizer.

(3) In preparation of the tabular grains set forth in Table 6, gelatin of a low molecular weight was used in accordance with the example described in Japanese Patent Provisional Publication No. 1(1989)-158426.

(4) In the tabular grains and normal crystal grains having grain structure of the emulsions set forth in Table 6, such a dislocation line as described in Japanese Patent Provisional Publication No. 3(1991)-237450 was observed by a high pressure electron microscope.

(ExC-1)

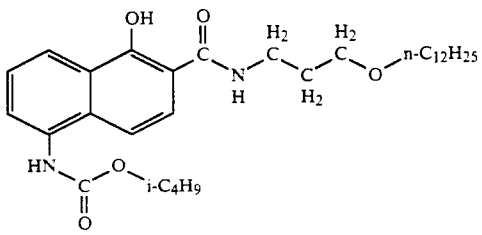

(ExC-2)

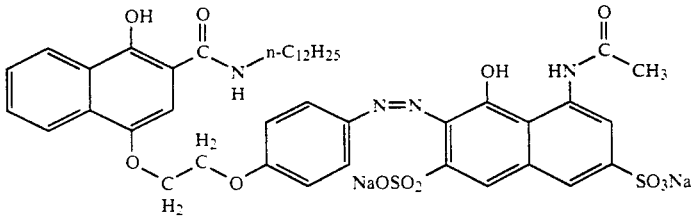

(ExC-3)

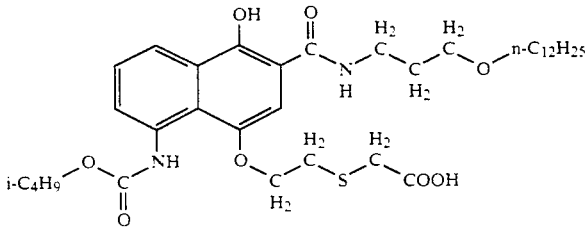

(ExC-4)

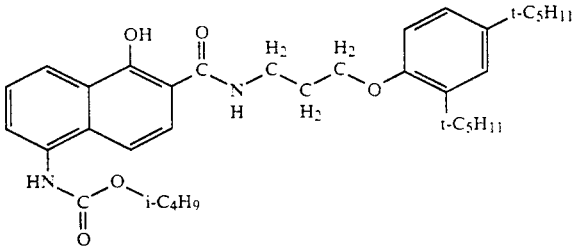

(ExC-5)

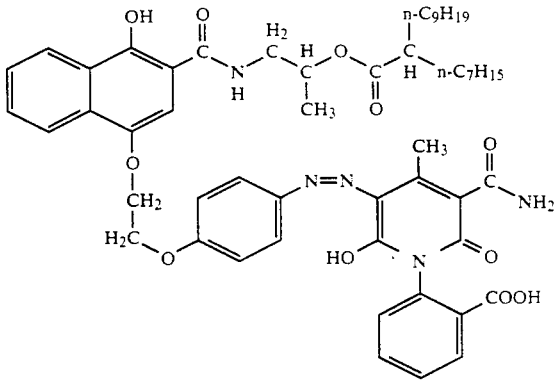

-continued
(ExC-6)
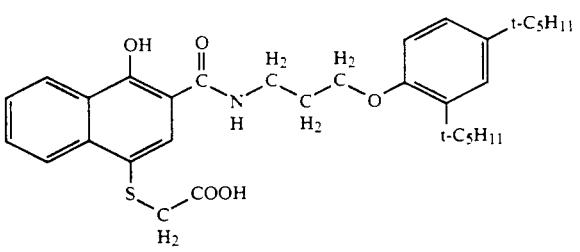
(ExC-7)
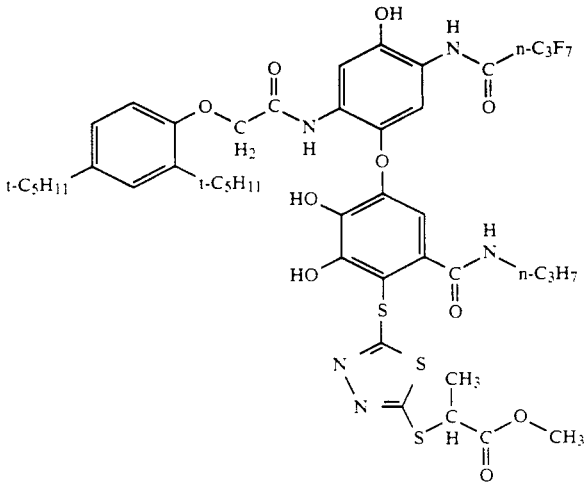
(ExC-8)
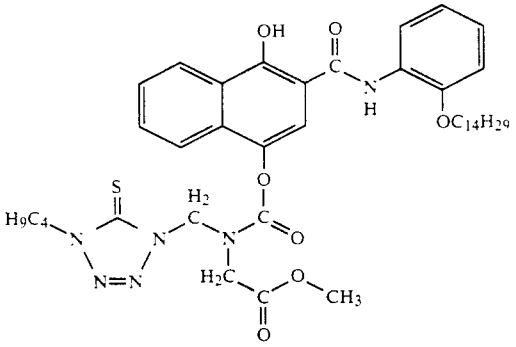
(ExM-1)
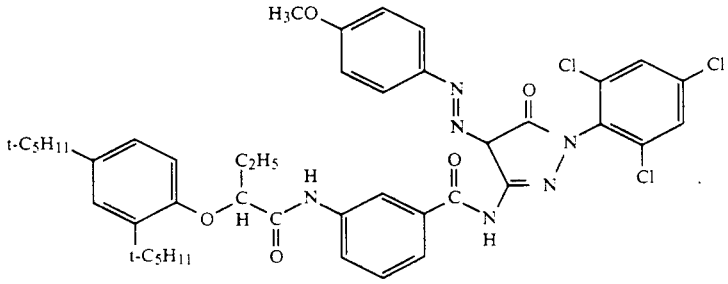

-continued
(ExM-2)
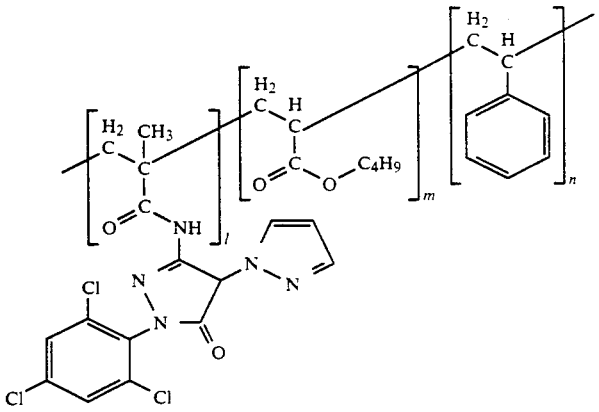
(l = 50, m = 25, n = 25, molecular weight = about 20,000)
(ExM-3)
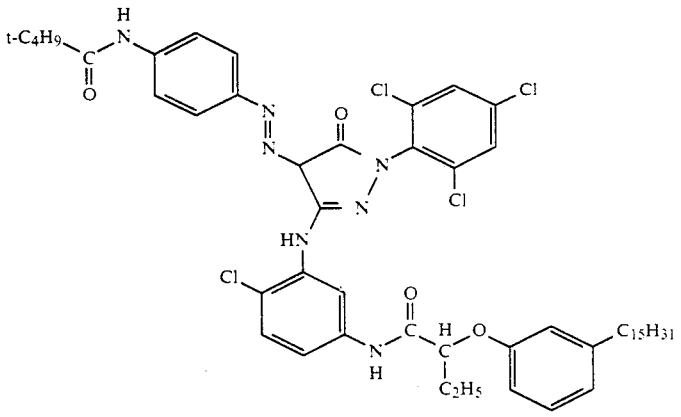
(ExM-4)
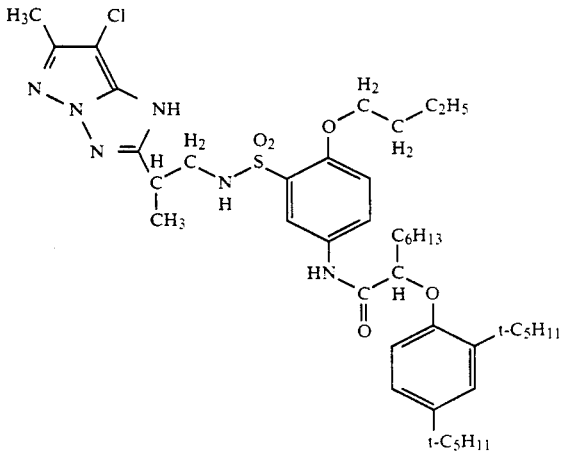

-continued
(ExM-5)
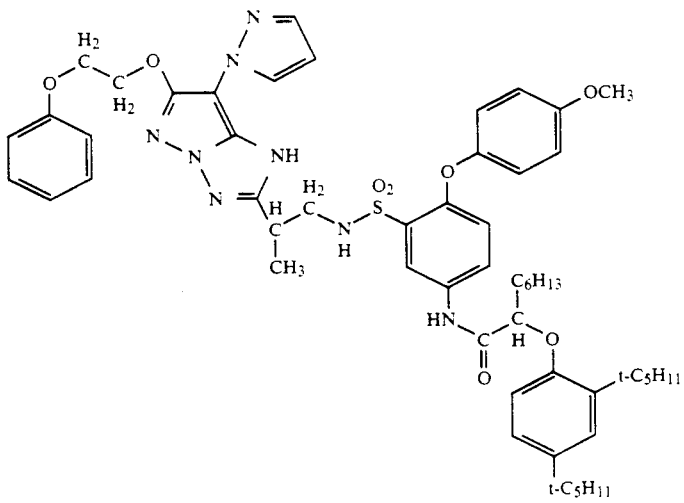
(ExY-1)
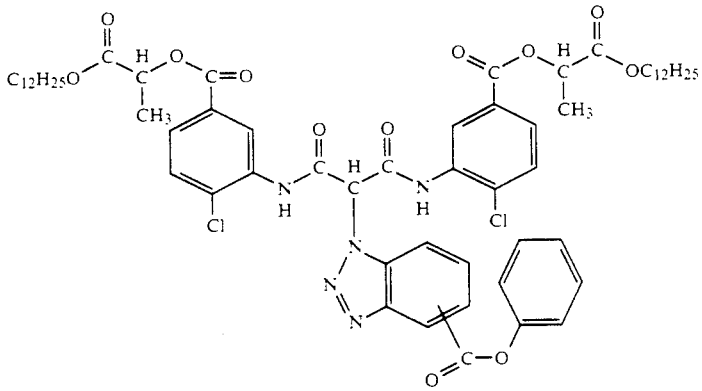
(ExY-2)
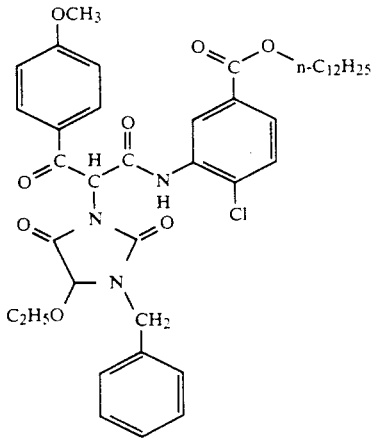

-continued
(ExY-3)
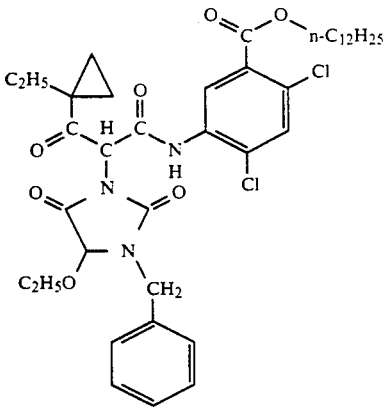
(ExY-4)
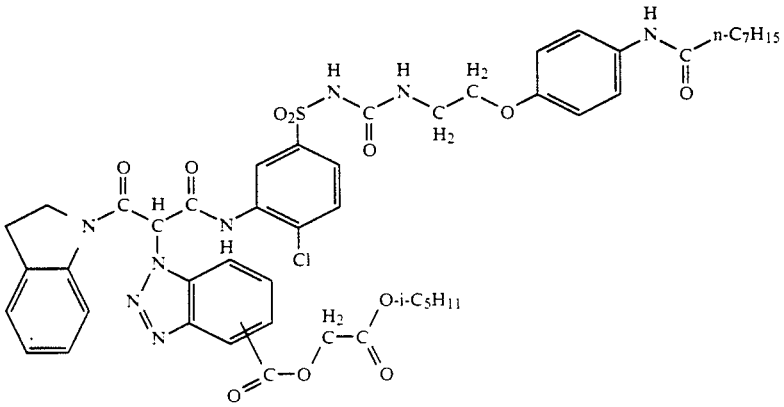
(ExF-1)
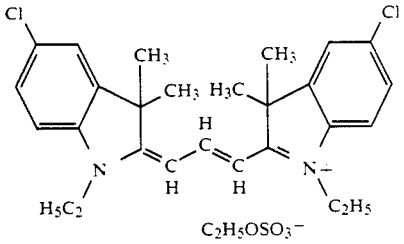
(Cpd-1)
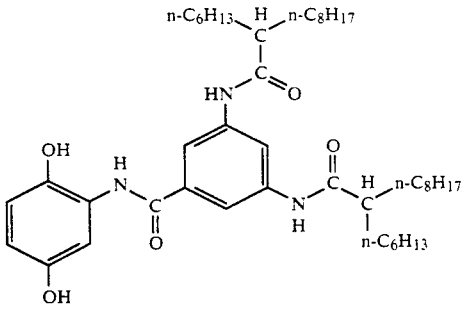
(Cpd-2)
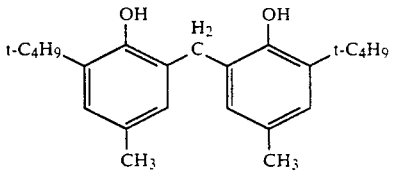

-continued
(Cpd-3)
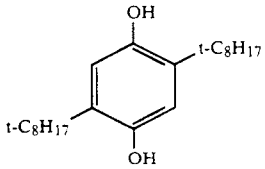
(UV-1)
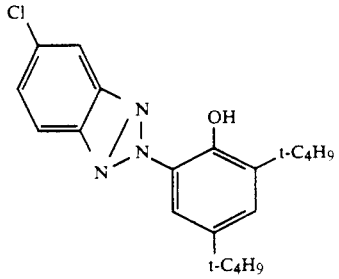
(UV-2)
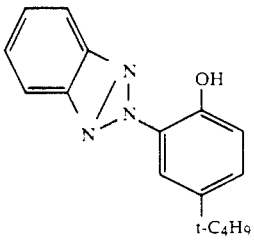
(UV-3)
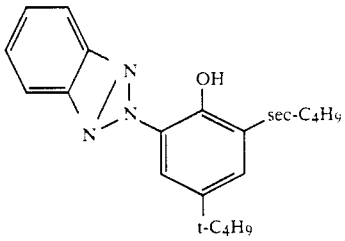
(UV-4)
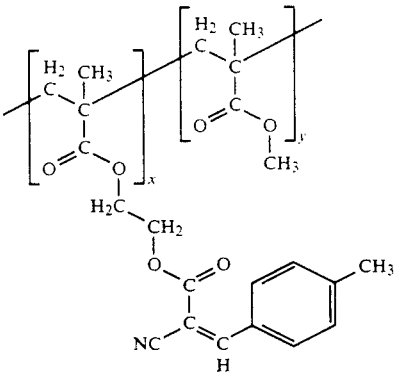
(x:y = 70:30, wt. %)
(UV-5)
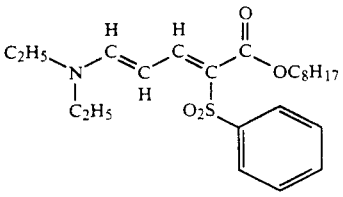
Tricresyl phosphate (HBS-1)
Di-n-butyl phthalate (HBS-2)

-continued
(HBS-3)
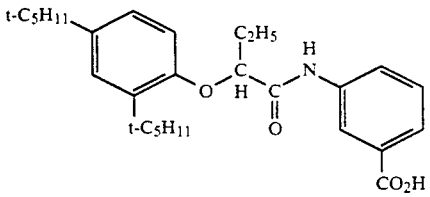
(ExS-1)
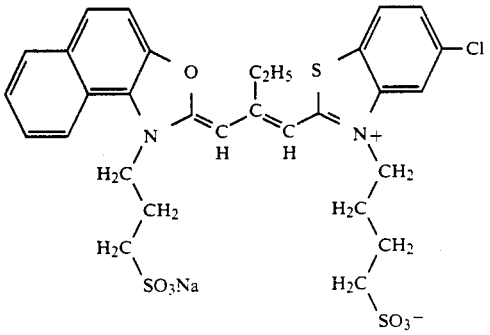
(ExS-2)
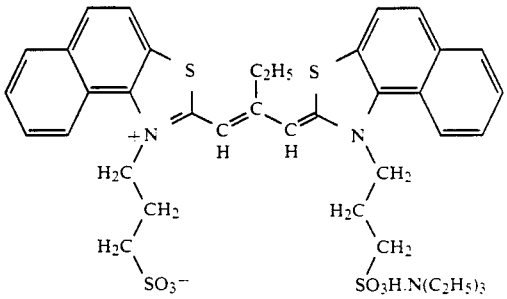
(ExS-3)
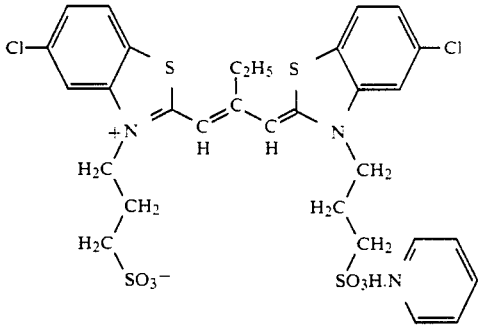
(ExS-4)
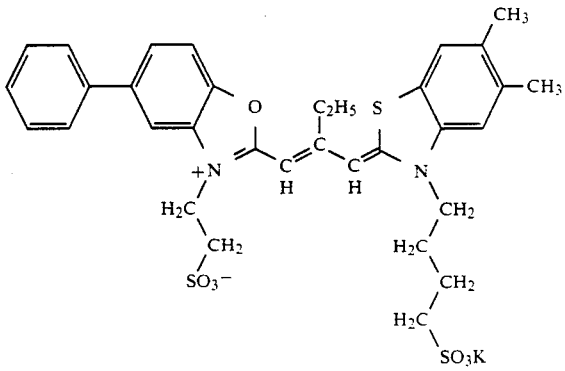

-continued
(ExS-5)
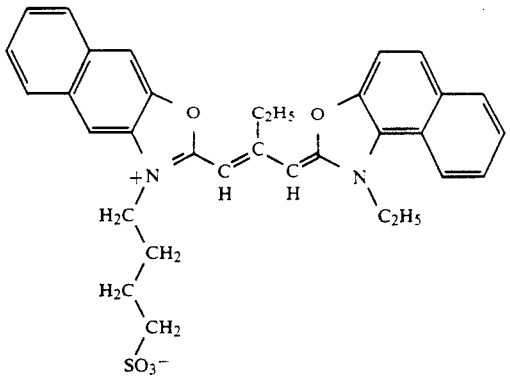
(ExS-6)
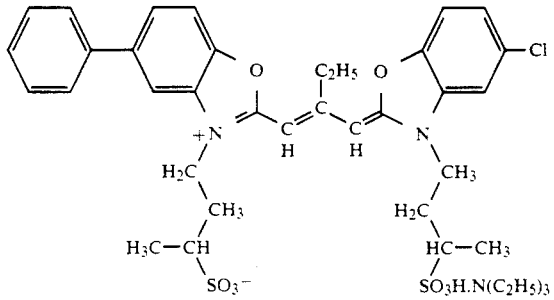
(ExS-7)
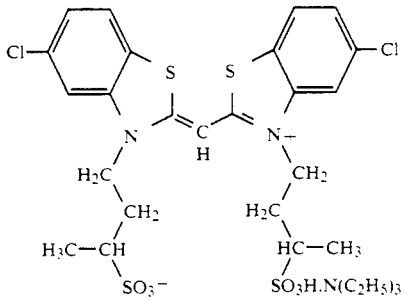
(S-1)
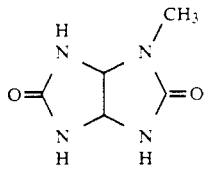
(H-1)
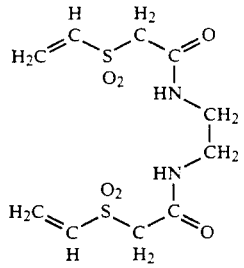
(B-1)
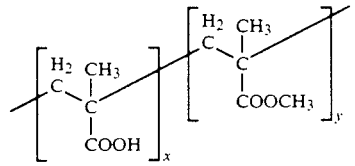
(x:y = 10:90)

-continued
(B-2)
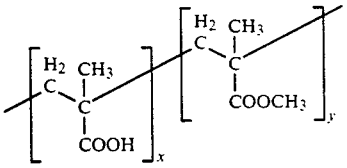
(x:y = 40:60)
(B-3)
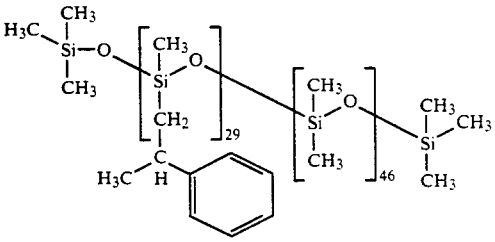
(B-4)
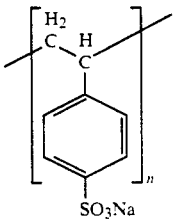
(B-5)
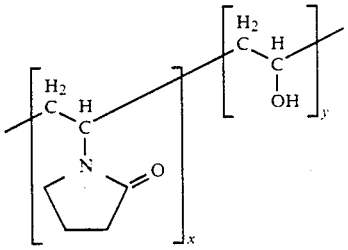
(x:y = 70:30)
(B-6)
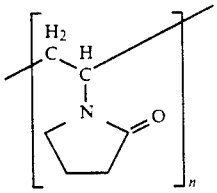
(Molecular weight is about 10,000.)
(W-1)
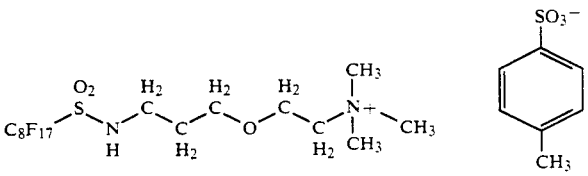
(W-2)
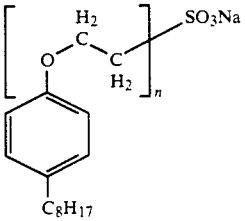
(n = 2 to 4)

-continued
(W-3)
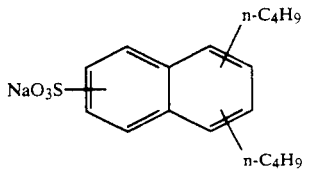
(F-1)
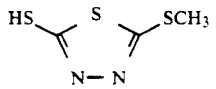
(F-2)
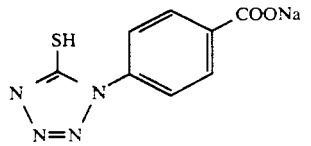
(F-3)
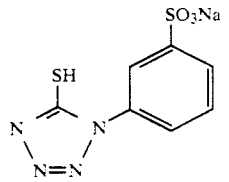
(F-4)
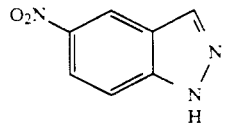
(F-5)
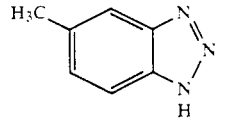
(F-6)
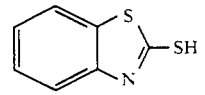
(F-7)
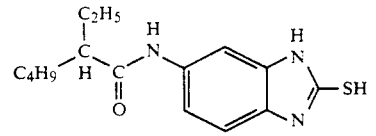
(F-8)
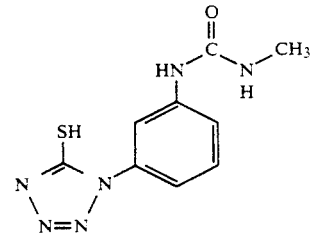
(F-9)
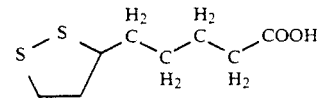

-continued

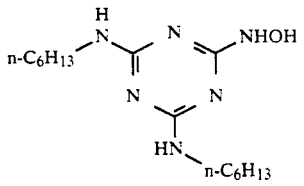
(F-10)

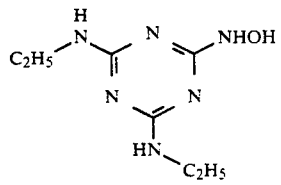
(F-11)

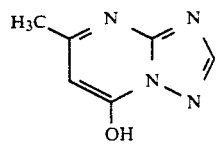
(F-12)

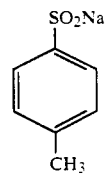
(F-13)

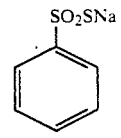
(F-14)

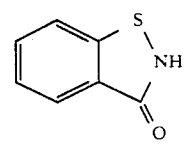
(F-15)

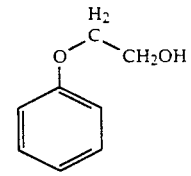
(F-16)

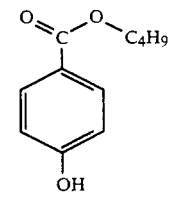
(F-17)

Each of the samples was cut to give a film having a width of 35 mm, and the film was used for picture-taking by a camera. Then, the film (1 $m^2$/day) was subjected to the following processes over 15 days using an automatic developing machine (FP-560B produced by Fuji Photo Film Co., Ltd.).

The processes are described below.

| Process | Period (sec) | Temperature (°C.) | Replenisher* | Volume of the Tank |
|---|---|---|---|---|
| Color developing | 185 | 38 | 600 ml | 17 l |
| Bleaching | 50 | 38 | 140 ml | 5 l |
| Bleach fix | 50 | 38 | — | 5 l |
| Fixing | 50 | 38 | 420 ml | 5 l |
| Washing | 30 | 38 | 980 ml | 3.5 l |

-continued

| Process | Period (sec) | Temperature (°C.) | Replenisher* | Volume of the Tank |
|---|---|---|---|---|
| Stabilizing (1) | 20 | 38 | — | 3 l |
| Stabilizing (2) | 20 | 38 | 560 ml | 3 l |
| Drying | 90 | 60 | | |

Remark*: The amount of the replenisher is an amount per 1 $m^2$ of the photographic material.

The stabilizing solution was replenished in accordance with a countercurrent replenishing system in which the overflowed liquid of the stabilizing bath (2) was introduced into the stabilizing bath (1). Further, all the overflowed liquid of the washing bath was introduced into the fixing bath. The replenishment to the bleach-fix bath was made by providing cutout portions on the top of the bleaching bath and the top of the fixing bath of the automatic developing machine so that all the overflowed liquid given by feeding the replenisher to the bleaching bath and the fixing bath was introduced into the bleach-fix bath. The amount of the developing solution carried by the photographic material to the bleaching bath, the amount of the bleaching solution carried by the photographic material to the bleach-fix bath, the amount of the bleach-fix solution carried by the photographic material to the fixing bath and the amount of the fixing solution carried by the photographic material to the washing bath were 65 ml, 50 ml, 50 ml and 50 ml, respectively, per 1 $m^2$ of the photographic material. The period of each crossover time was 6 seconds, and this period was included in the processing time of the previous stage.

The compositions of the processing solutions are described below.

| | Mother liquid | Replenisher |
|---|---|---|
| Color developing solution | | |
| Diethylenetriaminepentaacetic acid | 2.0 g | 2.0 g |
| 1-Hydroxyethylidene-1,1-diphosphonic acid | 3.3 g | 3.3 g |
| Sodium sulfite | 3.9 g | 5.1 g |
| Potassium carbonate | 37.5 g | 39.0 g |
| Potassium bromide | 1.4 g | 0.4 g |
| Potassium iodide | 1.3 mg | — |
| Hydroxylamine sulfate | 2.4 g | 3.3 g |
| 2-Methyl-4-[N-ethyl-N-(β-hydroxyethyl)amino] aniline sulfate | 4.5 g | 6.0 g |
| Water to make up to | 1.0 l | 1.0 l |
| pH | 10.05 | 10.15 |
| Bleaching solution | | |
| Ammonium 1,3-diaminopropanetetraacetate Fe(II) monohydrate | 130 g | 195 g |
| Ammonium bromide | 70 g | 105 g |
| Ammonium nitrate | 14 g | 21 g |
| Hydroxyacetic acid | 50 g | 75 g |
| Acetic acid | 40 g | 60 g |
| Water to make up to | 1.0 l | 1.0 l |
| pH (adjusted by ammonia water) | 4.4 | 4.4 |

Bleach-fix solution (for mother liquid)

A mixture of the mother liquid of the above-described bleaching solution and the mother liquid of the fixing solution described below (volume ratio = 15:85, pH = 7.0) was used as a bleach-fix solution.

| Fixing solution | Mother liquid | Replenisher |
|---|---|---|
| Ammonium sulfite | 19 g | 57 g |
| Aqueous solution of ammonium thiosulfate (700 g/l) | 280 ml | 840 ml |
| Imidazole | 15 g | 45 g |
| Ethylenediaminetetraacetic acid | 15 g | 45 g |
| Water to make up to | 1.0 l | 1.0 l |
| pH (adjusted by ammonia water and acetic acid) | 7.4 | 7.45 |

Washing water (for mother liquid and replenisher)

Tap water was deionized through a mixed-bed system column charged with strongly acidic cation exchange resin of H type (Amberlite IR-120B available from Rohm & Haas Co.) and strongly basic anion exchange resin of OH type (Amberlite IR-400 available from Rohm & Haas Co.) to contain calcium and magnesium ions in an amount of not more than 3 mg/l. To the resulting deionized water, 20 mg/l of sodium dichloroisocyanurate and 150 mg/l of sodium sulfate were added. The pH value of the obtained liquid was within the range of 6.5 to 7.5.

| Stabilizing solution | Mother liquid | Replenisher |
|---|---|---|
| Sodium p-toluenesulfinate | 0.03 g | Same |
| Polyoxyethylene-p-monononylphenylether (average polymerization degree: 10) | 0.2 g | Same |
| Disodium ethylenediaminetetraacetate | 0.05 g | Same |
| 1,2,4-Triazole | 1.3 g | Same |
| 1,4-Bis(1,2,4-triazole-1-ylmethyl) piperazine | 0.75 g | Same |
| Water to make up to | 1.0 l | Same |
| pH | 8.5 | Same |

Each of the samples No. 601-1 and No. 601-2 was exposed to light at a color temperature of 4,800 K for 1/100 second through a continuous wedge, and then subjected to the above-mentioned color developing process to measure optical density. Further, each of the samples No. 601-1 and No. 601-2 was stored for 7 days under the conditions of a temperature of 50° C. and a relative humidity of 80%, and then subjected to the same exposure and the same developing process as described above.

The change with the 7-day storage in the fog density and the logarithm of the exposure required to obtain an optical density of the fogging value plus 1.0 were measured. The results are set forth in Table 7.

As is evident from the results set forth in Table 7, in the case of using the compound of the invention, the change in the fog density and the change in the sensitivity were both small even after storage at a high temperature and a high humidity.

TABLE 7

| Sample No. | Change of Red Sensitive Layer | | Change of Green Sensitive Layer | | Change of Blue Sensitive Layer | |
|---|---|---|---|---|---|---|
| | Fog | $S_{1.0}$ | Fog | $S_{1.0}$ | Fog | $S_{1.0}$ |
| 601-1 | 0.06 | 0.10 | 0.08 | 0.18 | 0.06 | 0.11 |
| 601-2 | 0.02 | 0.04 | 0.05 | 0.06 | 0.03 | 0.06 |

EXAMPLE 7

Preparation of tabular grains

To 1 liter of water were added 6 g of potassium bromide and 7 g of gelatin, and to the resulting mixture placed in a container kept at 55° C. were added 37 cc of an aqueous solution of silver nitrate (silver nitrate: 4.00 g) and 38 cc of an aqueous solution containing 5.9 g of potassium bromide over 37 seconds by a double jet method with stirring of the mixture. Then, 18.6 g of gelatin was added to the mixture, and the temperature of the mixture was elevated to 70° C. To the mixture was further added 89 cc of an aqueous solution of silver nitrate (silver nitrate: 9.8 g) over 22 minutes. Then, 7 cc of a 25 % aqueous solution of ammonia was added to mixture to conduct physical ripening at the same temperature for 10 minutes. Thereafter, 6.5 cc of a 100% acetic acid solution was added. Successively, to the mixture were further added an aqueous solution containing 153 g of silver nitrate and an aqueous solution of potassium bromide over 35 minutes by a controlled double jet method while keeping the pAg value at 8.5. Then, 15 cc of a 2N solution of potassium thiocyanate was added to the mixture to conduct physical ripening at the same temperature for 5 minutes, and the temperature was lowered to 35° C. Thus, a monodispersed emulsion of silver bromide tabular grains having a mean diameter of projected area of 1.10μm, a thickness of 0.165μm and a distribution coefficient of grain diameter of 18.5%.

Thereafter, the soluble salts were removed from the emulsion by means of a precipitation method, and the temperature of the emulsion was elevated to 40° C. To the emulsion were added 30 g of gelatin, 2.35 g of phenoxyethanol and 0.8 g of sodium polystyrenesulfonate as a viscosity increasing agent. Then, the pH and pAg values of the emulsion were adjusted to 5.90 and 8.25, respectively, by the use of caustic soda and a silver nitrate solution.

The emulsion was then subjected to chemical sensitization while stirring at 56° C.

During the chemical sensitization, fine grains of AgI were added to the emulsion so that the emulsion had a silver iodide content of 0.2%.

The chemical sensitization was carried out as follows.

First, to the emulsion was added 0.043 mg of thiourea dioxide, and they were allowed to stand for 22 minutes to perform reduction sensitization. Then, to the emulsion were added 20 mg of 4-hydroxy-6-methyl-1,3,3a,7-tetraazaindene and 400 mg of the following sensitizing dye.

(Sensitizing dye)

-continued

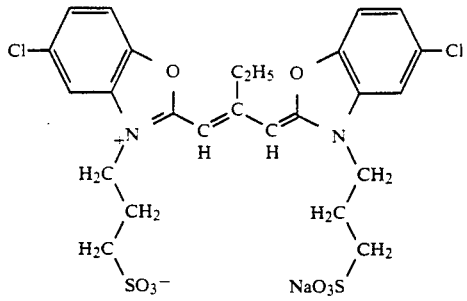

To the emulsion were further added 0.83 g of calcium chloride, 1.9 mg of sodium thiosulfate, 1.1 mg of the comparative compound (A) of Example 1 as a selenium sensitizer, 2.9 mg of chloroauric acid and 120 mg of potassium thiocyanate. After 30 minutes, the emulsion was cooled to 35° C.

Thus, tabular grains T-1 were prepared.

Preparation of Samples

To the tabular grains T-1 prepared above were added the following chemicals in the following amounts per 1 mol of the silver halide of the tabular grains T-1, to prepare a coating solution for an emulsion layer. Using this coating solution, a photographic material (sample No. 70) was prepared.

| | |
|---|---|
| Gelatin (including Ge 1 in the emulsion) | 65.6 g |
| Trimethylolpropane | 9 g |
| Dextran (average molecular weight: 39,000) | 18.5 g |
| Sodium polystyrenesulfonate (average molecular weight: 600,000) | 1.8 g |
| 1,2-Bis(vinylsulfonylacetamide)ethan (hardening agent, amount: adjusted so that the swell ratio was 230%.) | 34 mg |
| 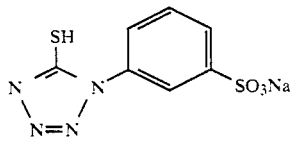 | 4.8 g |
| 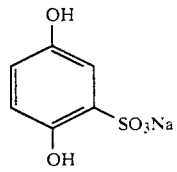 | |

A coating solution for a surface protective layer was prepared. The components of the solution and the amounts of the components are as follows.

| | |
|---|---|
| Gelatin | 0.966 g/m$^2$ |
| Sodium polyacrylate (average molecular weight: 400,000) | 0.023 g/m$^2$ |
| 4-Hydroxy-6-methyl-1,3,3a,7-tetraazaindene | 0.015 g/m$^2$ |

-continued

| | |
|---|---|
| 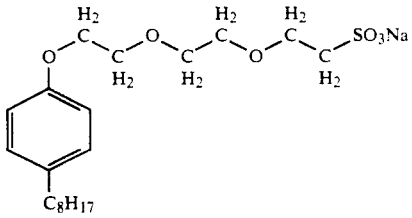 | 0.015 g/m² |
| 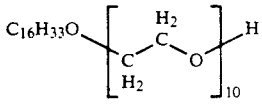 | 0.045 g/m² |
| 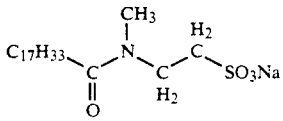 | 0.0065 g/m² |
| 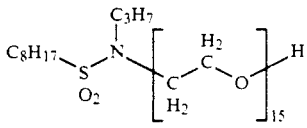 | 0.003 g/m² |
| 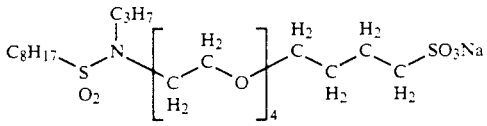 | 0.001 g/m² |
| 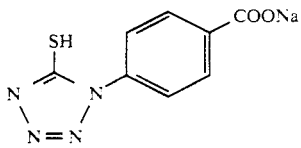 | 1.7 mg/m² |
| Polymethyl methacrylate (mean grain diameter: 3.7 μm) | 0.087 g/m² |
| Proxel (adjusted to pH 7.4 by NaOH) | 0.0005 g/m² |

Further, samples No. 71 and No. 72 were prepared by using the compound (I-7) (2.4 mg) and the compound (III-11) (4.0 mg) of the invention instead of the comparative compound (A).

Preparation of a Support (1) Preparation of a dye dispersion D-1 for an undercoating layer.

The following dye was subjected to ball milling in accordance with a manner described in Japanese Patent Provisional Publication No. 63(1988)-197943.

(Dye)

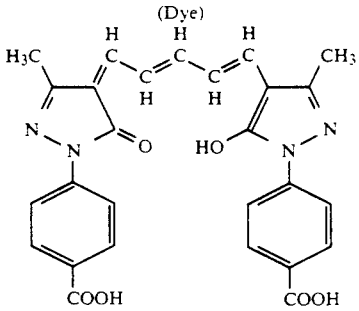

That is, 434 ml of water and 791 ml of a 6.7% aqueous solution of a surface active agent (trade name: Triton X-200 or TX-200) were introduced into a 2-liter ball mill. To the solution in the ball mill was added 20 g of the above dye. Further, 400 ml of zirconium oxide (ZrO) beads (diameter: 2 mm) was added to the ball mill, and the contents in the ball mill were pulverized over 4 days. Thereafter, to the pulverizate was added 160 g of 12.5% gelatin. After defoaming, ZrO beads were removed from the resulting mixture by filtration to obtain a dye dispersion. When the dye dispersion was observed, the diameters of the dye grains were over a wide range of 0.05 to 1.15μm, and the mean grain diameter was 0.37μm.

The dye dispersion was then subjected to centrifugal separation to remove dye grains having a diameter of not less than 0.9μm.

Thus, a dye dispersion D-1 was obtained.

(2) Preparation of a support

A biaxially oriented polyethylene terephthalate film (thickness: 183μm) was subjected to a corona discharge treatment. On one surface of the film thus treated was coated a coating solution for the first undercoating layer composed of the following components in an amount of 5.1 cc/m² by means of a wire bar coater, and the coated solution was dried at 175° C. for 1 minute.

Then, the other surface of the film was laos provided with the first undercoating layer in the same manner as described above. The polyethylene terephthalate used herein contained 0.04 wt. % of the following dye.

(Dye)

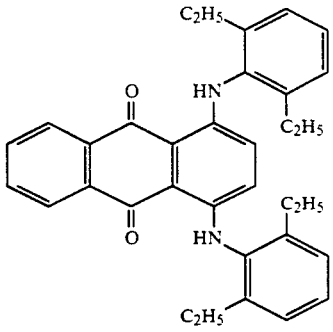

Coating solution for the first undercoating layer

| | |
|---|---|
| Butadiene/styrene copolymer latex solution (solid content: 40%, butadiene/styrene weight ratio: 31/69) | 79 cc |
| 4% Solution of 2,4-dichloro-6-hydroxy-s-triazine sodium salt | 20.5 cc |
| Distilled water | 900.5 cc |

In the above-mentioned latex solution, the following compound was contained as a dispersing agent in an amount of 0.04% by weight based on the latex solid content.

(Compound)

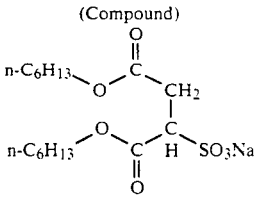

On each of the first undercoating layers formed in the above was coated a coating solution for the second undercoating layer composed of the following components by means of a wire bar coater in such a manner that the coating amounts of the components became the following amounts, and the coated solution was dried at 450° C.

| Coating solution for the second undercoating layer | |
|---|---|
| Gelatin | 160 mg/m² |
| Dye dispersion D-1 (dye solid content: 26 mg/m²) | 8 mg/m² |

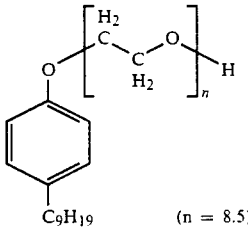

(n = 8.5)

| | |
|---|---|
| | 0.27 mg/m² |

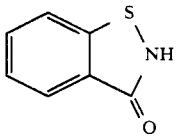

-continued

| Coating solution for the second undercoating layer | |
|---|---|
| Matting agent (grains of polymethyl methacrylate, mean grain diameter: 2.5 μm) | 2.5 mg/m² |

Preparation of photographic materials

The support prepared as above was coated with the coating solution for an emulsion layer and the coating solution for a surface protective layer simultaneously by a pressing out method. The amount of the silver coated on one surface was 1.75 g/m².

Each of the photographic materials (samples No. 70, No. 71 and No. 72) prepared as above was exposed to light from both sides of the sample for 0.05 second using an X-ray ortho screen (HR-4 Produced by Fuji Photo Film Co., Ltd.), to evaluate the sensitivity.

In this experiment, an automatic developing machine obtained by altering an automatic developing machine FPM-9000 type produced by Fuji Photo Film Co., Ltd. was used. The processing stages are set forth in Table 8. In this experiment, about 200 sheets (each sheet: 10×12 inch size) of the photographic materials were processed per one day.

TABLE 8

| Process | Amount of Processing Solution | Temperature | Length of Processing path | Period |
|---|---|---|---|---|
| Developing | 15 l | 35° C. | 613 mm | 8.8 sec |
| Fixing | 15 l | 32° C. | 539 mm | 7.7 sec |
| Washing | 15 l | 17° C. | 263 mm | 3.8 sec |
| Squeegee | | | 304 mm | 4.4 sec |
| Drying | | 58° C. | 368 mm | 5.3 sec |
| Total | | | 2.087 mm | 30.0 sec |

Remark:
A ratio of the liquid surface area to the volume of the processing bath is 25 cm²/l.

Washing was made by the use of running water.

Drying was made by applying warm air using a pair of heat rollers of 100° C.

The processing solutions and the replenishers thereof are described below.

Developing process

| Preparation of concentrated solutions | |
|---|---|
| (Developing solution) | |
| Part A | |
| Potassium hydroxide | 270 g |
| Potassium sulfite | 1,125 g |
| Sodium carbonate | 450 g |
| Boric acid | 75 g |
| Diethylene glycol | 150 g |
| Diethylenetriaminepentaacetic acid | 30 g |
| 1-(N,N-Diethylamino)ethyl-5-mercaptotetrazole | 1.5 g |
| Hydroquinone | 405 g |
| 4-Hydroxymethyl-4-methyl-1-phenyl-3-pyrazolidone | 30 g |
| Water | to make up to 4,500 ml |
| Part B | |
| Tetraethylene glycol | 750 g |
| 3-3'-Dithiobishydrocinnamic acid | 3 g |
| Glacial acetic acid | 75 g |
| 5-Nitroindazole | 4.5 g |
| 1-Phenyl-3-pyrazolidone | 67.5 g |
| Water | to make up to 1,000 ml |
| Part C | |
| Glutaraldehyde (50 wt./wt. %) | 150 g |
| Potassium bromide | 15 g |
| Potassium metabisulfite | 120 g |

-continued

| Preparation of concentrated solutions | |
|---|---|
| Water | to make up to 750 ml |
| (Fixing solution) | |
| Ammonium thiosulfate (70 wt./vol. %) | 3,000 ml |
| Disodium ethylenediaminetetraacetate dihydrate | 0.45 g |
| Sodium sulfite | 225 g |
| Boric acid | 60 g |
| 1-(N,N-dimethylamino)ethyl-5-mercaptotetrazole | 15 g |
| Tartaric acid | 48 g |
| Glacial acetic acid | 675 g |
| Sodium hydroxide | 225 g |
| Sulfuric acid (36N) | 58.5 g |
| Aluminum sulfate | 150 g |
| Water | to make up to 6.000 ml |
| pH | 4.68 |

Preparation of processing solutions

The parts A, B and C of the concentrated developing solution described above were charged into a container in which plural receptacles for each parts were combined with each other.

The concentrated fixing solution described above was charged into a container of the same kind as mentioned above.

First, 300 ml of an aqueous solution containing 54 g of acetic acid and 55.5 g of potassium bromide was added to the developing bath as a starter.

Each of the containers containing the processing agents was put upside down onto a cutting tool of a stock tank for processing agent equipped on the side wall of the automatic developing machine to break a seal of the container cap, so as to fill the stock tank with the processing agent of each container.

The developing bath and the fixing bath were then filled with the processing agents in the following amounts by driving each pump equipped in the automatic developing machine.

Further, every time 8 sheets of the photographic materials (in terms of 10×12 inch size) were processed, a mixture containing the processing agents and water in the following amounts was fed to each processing bath as the replenisher.

| Developing solution | |
|---|---|
| Part A | 60 ml |
| Part B | 13.4 ml |
| Part C | 10 ml |
| Water | 116.6 ml |
| pH | 10.50 |
| Fixing solution | |
| Concentrated solution | 80 ml |
| Water | 120 ml |
| pH | 4.62 |

The washing bath was filled with tap water.

Each of the samples was measured on the photographic sensitivity immediately after the preparation thereof and the photographic sensitivity after stored for 3 days under the conditions of a temperature of 45° C. and a relative humidity of 80%, and a change in the photographic sensitivity was determined. The results are set forth in Table 9, wherein the change in the photographic sensitivity is expressed by a change of logarithm of the exposure required to obtain an optical density of the fogging value plus 0.5.

TABLE 9

| Sample No. | Compound No. | Change in Sensitivity |
|---|---|---|
| 70 | A | 0.09 |
| 71 | I-7 | 0.04 |
| 72 | III-1 | 0.05 |

Remark:
Compound (A): N,N-dimethylselenourea

It was confirmed that in the case of using the selenium compounds of the invention, reduction of the sensitivity during the storage at a high temperature and a high humidity was smaller as compared with the case of using the conventionally known selenium compound (A).

We claim:

1. A silver halide photographic material which comprises a silver halide emulsion layer and a non-light-sensitive hydrophilic colloidal layer provided on a support, wherein the silver halide emulsion layer or the hydrophilic colloidal layer contains a selenium compound represented by the formula (I), (II) or (III):

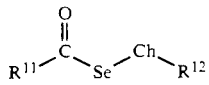

(I)

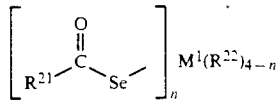

(II)

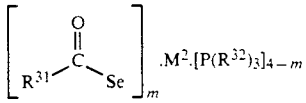

(III)

in which $R^{11}$ is an aliphatic group, an aromatic group, a heterocyclic group, $—OR^{13}$ or $—NR^{14}R^{15}$; each of $R^{13}$, $R^{14}$ and $R^{15}$ independently is hydrogen, an aliphatic group or an aromatic group; Ch is S, Se or Te; $R^{12}$ is an aliphatic group, an aromatic group, a heterocyclic group or $—COR^{16}$; $R^{16}$ is an aliphatic group, an aromatic group, a heterocyclic group, $—OR^{17}$ or $—NR^{18}R^{19}$; each of $R^{17}$, $R^{18}$ and $R^{19}$ independently is hydrogen, an aliphatic group or an aromatic group; $R^{21}$ is an aliphatic group, an aromatic group, a heterocyclic group, $—OR^{23}$ or $—NR^{24}R^{25}$; each of $R^{23}$, $R^{24}$ and $R^{25}$ independently is hydrogen, an aliphatic group or an aromatic group; $M^1$ is Ge, Sn or Pb; $R^{22}$ is an aliphatic group or an aromatic group; n is 1 or 2; $R^{31}$ is an aliphatic group, an aromatic group, a heterocyclic group, $—OR^{33}$ or $—NR^{34}R^{35}$; each of $R^{33}$, $R^{34}$ and $R^{35}$ independently is hydrogen, an aliphatic group or an aromatic group; $M^2$ is Ni, Pd or Pt; $R^{32}$ is an aliphatic group or an aromatic group; m is 1 or 2; and each of the aliphatic, aromatic and heterocyclic groups may have one or more substituent groups.

2. The photographic material as claimed in claim 1, wherein $R^{11}$ in the formula (I) is an aromatic group, $—OR^{13}$ or $—NR^{14}R^{15}$.

3. The photographic material as claimed in claim 1, wherein $R^{12}$ in the formula (I) is an aromatic group or $—COR^{16}$.

4. The photographic material as claimed in claim 1, wherein $R^{21}$ in the formula (II) is an aromatic group, $—OR^{23}$ or $—NR^{24}R^{25}$.

5. The photographic material as claimed in claim 1, wherein $R^{22}$ in the formula (II) is an alkyl group or an aryl group.

6. The photographic material as claimed in claim 1, wherein $R^{31}$ in the formula (III) is an aromatic group, $—OR^{33}$ or $—NR^{34}R^{35}$.

7. The photographic material as claimed in claim 1, wherein $R^{32}$ in the formula (III) is an alkyl group or an aryl group.

8. The photographic material as claimed in claim 1, wherein the selenium compound represented by the formula (I), (II) or (III) is contained in an amount of $10^{-8}$ to $10^{-4}$ mol based on 1 mol of silver halide.

9. The photographic material as claimed in claim 1, wherein the selenium compound represented by the formula (I), (II) or (III) is contained in the silver halide emulsion layer.

10. The photographic material as claimed in claim 1, wherein the selenium compound is according to formula (I).

11. The photographic material as claimed in claim 1, wherein the selenium compound is according to formula (II).

12. The photographic material as claimed in claim 1, wherein the selenium compound is according to formula (III).

13. A silver halide photographic material which comprises a silver halide emulsion layer provided on a support, wherein the silver halide emulsion is sensitized with a selenium compound represented by the formula (I), (II) or (III):

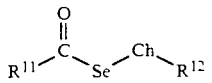

(I)

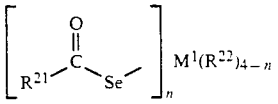

(II)

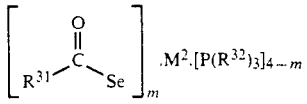

(III)

in which $R^{11}$ is an aliphatic group, an aromatic group, a heterocyclic group, $—OR^{13}$ or $—NR^{14}R^{15}$ each of $R^{13}$, $R^{14}$ and $R^{15}$ independently is hydrogen, an aliphatic group or an aromatic group; Ch is S, Se or Te; $R^{12}$ is an aliphatic group, an aromatic group, a heterocyclic group or $—COR^{16}$; $R^{16}$ is an aliphatic group, an aromatic group, a heterocyclic group, $—OR^{17}$ or $—NR^{18}R^{19}$; each of $R^{17}$, $R^{18}$ and $R^{19}$ independently is hydrogen, an aliphatic group or an aromatic group; $R^{21}$ is an aliphatic group, an aromatic group, a heterocyclic group, $—OR^{23}$ or $—NR^{24}R^{25}$; each of $R^{23}$, $R^{24}$ and $R^{25}$ independently is hydrogen, an aliphatic group or an aromatic group; $M^1$ is Ge, Sn or Pb; $R^{22}$ is an aliphatic group or an aromatic group; n is 1 or 2; $R^{31}$ is an aliphatic group, an aromatic group, a heterocyclic group, $—OR^{33}$ or $—NR^{34}R^{35}$; each of $R^{33}$, $R^{34}$ and $R^{35}$ independently is hydrogen, an aliphatic group or an aromatic group; $M^2$ is Ni, Pd or Pt; $R^{32}$ is an aliphatic group or an aromatic group; m is 1 or 2; and each of the aliphatic, aromatic and heterocyclic groups may have one or more substituent groups.

14. The photographic material as claimed in claim 13, wherein the silver halide emulsion is sensitized with the selenium compound in an amount of $10^{-8}$ to $10^{-4}$ mol based on 1 mol of silver halide.

15. The photographic material as claimed in claim 13, wherein the silver halide emulsion is sensitized with the selenium compound at a pAg in the range of 6 to 11.

16. The photographic material as claimed in claim 13, wherein the silver halide emulsion is sensitized with the selenium compound at a pH in the range of 3 to 10.

17. The photographic material as claimed in claim 13, wherein the silver halide emulsion is sensitized with the selenium compound at a temperature in the range of 40° to 95° C.

18. The photographic material as claimed in claim 13, wherein the silver halide emulsion is sensitized with the selenium compound in combination with a gold sensitizer.

19. The photographic material as claimed in claim 13, wherein the silver halide emulsion is sensitized with the selenium compound in the presence of a silver halide solvent.

20. The photographic material as claimed in claim 13, wherein the selenium compound is according to formula (I).

21. The photographic material as claimed in claim 13, wherein the selenium compound is according to formula (II).

22. The photographic material as claimed in claim 13, wherein the selenium compound is according to formula (III).

* * * * *